US010378185B2

(12) United States Patent
Saitoh et al.

(10) Patent No.: US 10,378,185 B2
(45) Date of Patent: Aug. 13, 2019

(54) WORK MACHINE

(71) Applicant: Hitachi Construction Machinery Co., Ltd., Taito-ku, Tokyo (JP)

(72) Inventors: Teppei Saitoh, Chiyoda-ku (JP); Yuki Akiyama, Tsuchiura (JP); Kenji Hiraku, Tsuchiura (JP); Hiromasa Takahashi, Tsuchiura (JP); Juri Shimizu, Chiyoda-ku (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 292 days.

(21) Appl. No.: 15/124,554

(22) PCT Filed: Mar. 10, 2015

(86) PCT No.: PCT/JP2015/057053
§ 371 (c)(1),
(2) Date: Sep. 8, 2016

(87) PCT Pub. No.: WO2015/198644
PCT Pub. Date: Dec. 30, 2015

(65) Prior Publication Data

US 2017/0016208 A1 Jan. 19, 2017

(30) Foreign Application Priority Data

Jun. 26, 2014 (JP) ..... 2014-131806

(51) Int. Cl.
*E02F 9/22* (2006.01)
*E02F 9/12* (2006.01)
(Continued)

(52) U.S. Cl.
CPC ..... *E02F 9/2217* (2013.01); *E02F 9/123* (2013.01); *E02F 9/22* (2013.01); *E02F 9/2239* (2013.01);
(Continued)

(58) Field of Classification Search
CPC ..... E02F 9/2239; E02F 9/2296; E02F 9/123; E02F 9/2292; E02F 9/2217; E02F 3/32;
(Continued)

(56) References Cited

U.S. PATENT DOCUMENTS 4,369,625 A * 1/1983 Izumi ..... E02F 9/2292 414/699
9,506,480 B2 * 11/2016 Hiraku ..... E02F 9/2235
(Continued)

FOREIGN PATENT DOCUMENTS

JP 56-6901 A 1/1981
JP 61-151333 A 7/1986

OTHER PUBLICATIONS

International Search Report (PCT/ISA/210) issued in PCT Application No. PCT/JP2015/057053 dated Jun. 2, 2015 with English translation (four pages).
(Continued)

*Primary Examiner* — Thomas E Lazo
*Assistant Examiner* — Richard C Drake
(74) *Attorney, Agent, or Firm* — Crowell & Moring LLP

(57) ABSTRACT

To provide a work machine capable of efficiently regenerating the energy owned by hydraulic fluid during a swing deceleration. In the present invention, when a swing deceleration detection section 57*a* detects the state of a revolving upperstructure 102 being decelerated, when an operation judgment section 57*c* judges the state that a double-tilting pump/motor 14 is not supplying hydraulic fluid to any of a boom cylinder 1 and an arm cylinder 3, and when the number of double-tilting pumps/motors 14, 18 having supplied hydraulic fluid to a swing hydraulic motor 7 in the state before the swing deceleration detection section 57*a* detects the state of the revolving upperstructure 102 being decelerated is equal to one or more, a pump valve control section
(Continued)

57*d* controls changeover valves 43*a*, 45*b*, 45*d*, 49*d* to open and increases the displacements of the double-tilting pumps/motors 14, 18 to the side to make suction pressures become higher than discharge pressures of the double-tilting pumps/motors 14, 18 so that the double-tilting pumps/motors 14, 18 operate as motors.

2 Claims, 7 Drawing Sheets

(51) Int. Cl.

| | |
|---|---|
| ***F15B 11/17*** | (2006.01) |
| ***F15B 13/02*** | (2006.01) |
| ***F15B 13/08*** | (2006.01) |
| ***F15B 21/14*** | (2006.01) |
| *E02F 3/32* | (2006.01) |

(52) U.S. Cl.
CPC ..... *E02F 9/2292* (2013.01); *E02F 9/2296* (2013.01); *F15B 11/17* (2013.01); *F15B 13/024* (2013.01); *F15B 13/08* (2013.01); *F15B 21/14* (2013.01); *E02F 3/32* (2013.01); *F15B 2211/20546* (2013.01); *F15B 2211/20561* (2013.01); *F15B 2211/20569* (2013.01); *F15B 2211/20576* (2013.01); *F15B 2211/27* (2013.01); *F15B 2211/30595* (2013.01); *F15B 2211/31529* (2013.01); *F15B 2211/327* (2013.01); *F15B 2211/613* (2013.01); *F15B 2211/6309* (2013.01); *F15B 2211/6346* (2013.01); *F15B 2211/6652* (2013.01); *F15B 2211/7058* (2013.01); *F15B 2211/7135* (2013.01); *F15B 2211/7142* (2013.01); *F15B 2211/761* (2013.01); *F15B 2211/853* (2013.01)

(58) Field of Classification Search
CPC ..... E02F 9/22; F15B 13/024; F15B 11/17; F15B 21/14; F15B 2211/20546; F15B 2211/27; F15B 2211/20576; F15B 2211/20561; F15B 2211/853; F15B 2211/7142; F15B 2211/7135; F15B 2211/6652; F15B 2211/6346; F15B 2211/6309; F15B 2211/613; F15B 2211/327; F15B 2211/31529; F15B 2211/30595; F15B 2211/761; F15B 2211/20569; F15B 2211/7058
See application file for complete search history.

(56) References Cited

U.S. PATENT DOCUMENTS

| | | | | |
|---|---|---|---|---|
| 9,879,405 | B2 * | 1/2018 | Saitoh | E02F 9/2289 |
| 2005/0246082 | A1 * | 11/2005 | Miki | E02F 9/2075 701/50 |
| 2013/0098016 | A1 | 4/2013 | Opdenbosch et al. | |
| 2013/0098017 | A1 * | 4/2013 | Knussman | E02F 9/2242 60/327 |
| 2013/0111888 | A1 * | 5/2013 | Schwab | F15B 7/006 60/327 |
| 2013/0312399 | A1 * | 11/2013 | Hiraku | F15B 15/18 60/422 |
| 2014/0165549 | A1 * | 6/2014 | Gabibulayev | F15B 21/001 60/421 |
| 2015/0047331 | A1 * | 2/2015 | Blum | E02F 9/2217 60/327 |
| 2015/0059325 | A1 * | 3/2015 | Knussman | E02F 9/2217 60/327 |

OTHER PUBLICATIONS

Japanese-language Written Opinion (PCT/ISA/237) issued in PCT Application No. PCT/JP2015/057053 dated Jun. 2, 2015 (four pages).

* cited by examiner

WORK MACHINE

TECHNICAL FIELD

The present invention relates to a work machine such as, for example, a hydraulic excavator having a revolving upperstructure and particularly, to a work machine provided with a hydraulic circuit that connects a hydraulic actuator such as a hydraulic motor or the like and a hydraulic pump/motor in a closed circuit style through a flow path enabling hydraulic fluid to flow therethrough.

BACKGROUND ART

In construction machines such as hydraulic excavators and the like, the mainstream is a work machine using a hydraulic circuit so called open circuit wherein hydraulic fluid is fed from a hydraulic pump to a hydraulic cylinder through a throttle configured by a control valve while the hydraulic fluid (return hydraulic fluid) flowing out from the hydraulic cylinder is discharged into a hydraulic fluid reservoir. The hydraulic circuit called an open circuit uses the throttle configured by the control valve and hence, is large in pressure loss attributed to the throttle.

In recent years, there have been developed work machines using a hydraulic circuit so called closed circuit in which connections are made annularly (in a closed circuit style) so that hydraulic fluid discharged from a hydraulic pump/motor is fed directly to a hydraulic actuator such as a hydraulic cylinder, a hydraulic motor or the like while the hydraulic fluid upon completion of a prescribed work by driving the hydraulic actuator is returned directly to the hydraulic pump/motor. The hydraulic circuit called a closed circuit is excellent in the performance of fuel efficiency because of being little in pressure loss attributed to the throttle and enabling the hydraulic pump/motor to regenerate the energy owned by the return hydraulic fluid from the hydraulic actuator. Further, there has also been proposed a hydraulic circuit wherein these closed circuit and open circuit are combined.

A swing deceleration regenerative control has been known as one of control techniques for hydraulic circuits called closed circuits of this kind. The swing deceleration regenerative control is designed so that during a swing deceleration of a revolving upperstructure in a work machine, the hydraulic pressure force (brake force) resistant to inertia energy (hereafter referred to as "swing deceleration regenerative energy") makes a hydraulic pump/motor that is connected to a hydraulic pump in a closed circuit style, operate as a hydraulic motor, so as to assist the driving of an engine or the like and hence, to reduce fuel consumption. That is, the force generated by the driving of the hydraulic pump/motor is transmitted to a drive source such as an engine or the like through a power transmission mechanism such as gears, so that the energy that is originally required for the driving of the drive source can be reduced. In particular, where the drive source is an engine, it becomes possible to reduce the consumption of light oil required to drive the engine. Like this, by the use of the swing deceleration regenerative control, the reduction of fuel consumption becomes possible.

Further, Patent Literature 1 discloses prior art in which closed circuits of this kind are combined. In Patent Literature 1, a plurality of closed circuits are provided in each of which one hydraulic pump/motor is independently connected to each of a plurality of hydraulic actuators such as hydraulic cylinders, hydraulic motors and the like so that the operation speed of each hydraulic actuator is controlled by the control of the discharge flow rate of the hydraulic fluid from each hydraulic pump/motor. Further, the hydraulic circuit is provided therein with a flow path that is for merging the hydraulic fluids discharged from two hydraulic pumps/motors connected to a plurality, for example two, of closed circuits, and the flow path is provided with a flow combining valve. At a high-speed driving of the hydraulic actuator, the flow combining valve is operated to open, so that the hydraulic fluids discharged from these two hydraulic pumps/motors are merged to be supplied to the hydraulic actuator.

CITATION LIST

Patent Literature

Patent Literature 1:
United States Patent Application Publication No. 2013/0098016

SUMMARY OF THE INVENTION

Technical Problem

In the prior art disclosed in the aforementioned Patent Literature 1, there is described no more than a configuration that drives hydraulic actuators at a high speed. Further, even where the hydraulic fluids discharged from the plurality of hydraulic pumps/motors are merged and supplied in order that the respective hydraulic pumps/motors connected to the plurality of closed circuits drive a specified hydraulic actuator at a high speed, it results that, in executing the aforementioned swing deceleration regenerative control, the hydraulic fluid discharged from a swing hydraulic motor is supplied only to one hydraulic pump/motor connected to the swing hydraulic motor. For this reason, even where the swing deceleration regenerative control is carried out in the state that the swing driving is performed while the hydraulic fluids discharged from the plurality of hydraulic pumps/motors are supplied to the swing hydraulic motor, swing deceleration regenerative energy cannot be regenerated so much.

Further, where for example, the swing deceleration of a revolving upperstructure is directed by the operation of an operating lever used in driving the swing of the revolving upperstructure, the displacement of the hydraulic pump/motor is controlled in correspondence to the manipulated variable of the operating lever. In this case, the displacement of the hydraulic pump is controlled to become small. Thus, the amount of the swing deceleration regenerative energy that is regenerated by the hydraulic pump/motor with the revolving upperstructure being decelerated becomes little, so that the regenerative ratio by the hydraulic pump/motor of the swing deceleration regenerative energy comes to deteriorate.

The present invention has been made taking the aforementioned circumstances in the prior art into consideration, and an object thereof is to provide a work machine capable of efficiently regenerating the energy owned by hydraulic fluid during a swing deceleration.

Solution to Problem

In order to attain this object, the present invention includes a first hydraulic circuit in which a hydraulic motor as a first actuator for drivingly swinging a revolving upperstructure and a first pump/motor enabling the outflow/inflow of hydraulic fluid in both directions and being controllable in displacement are connected in a closed circuit style by a flow path enabling hydraulic fluid to flow and in which a first switching device is provided for selectively opening the flow path between the hydraulic motor and the first pump/motor; a second hydraulic circuit in which a second hydraulic actuator differing from the hydraulic motor and a second pump/motor enabling the outflow/inflow of hydraulic fluid in both directions and being controllable in displacement are connected in a closed circuit style by a flow path enabling hydraulic fluid to flow and in which a second switching device is provided for selectively opening the flow path between the second hydraulic actuator and the second pump/motor; a combining flow path connected between the first hydraulic circuit and the second hydraulic circuit; a first combining flow path switching device that selectively opens the first combining flow path; and a control device that controls the first and second pumps/motors, the first and second switching devices and the first combining flow path switching device; wherein the control device includes a swing deceleration detection section that detects the state of the revolving upperstructure being decelerated, a pump operation judgment section that judges the operation state of the second pump/motor, and a control section that controls the displacements of the first and second pumps/motors and the selective openings of the first and second switching devices and the first combining flow path switching device; and wherein, when the swing deceleration detection section detects the state of the revolving upperstructure being decelerated, when the pump operation judgment section judges the state that the second pump/motor is not supplying hydraulic fluid to the second hydraulic actuator, and when inertia energy attendant on the swing operation is unable to be regenerated by the first pump/motor only, the control section outputs an open signal to the first switching device, outputs a closing signal to the second switching device, outputs an open signal to the first combining flow path switching device that merges the second hydraulic closed circuit and the first hydraulic closed circuit, and further controls the displacement of the first pump/motor and the displacement of the second pump/motor to make respective suction pressures higher than respective discharge pressures so that the first pump/motor and the second pump/motor operate as motors.

According to the present invention configured like this, when the pump operation judgment section judges the state that second pump/motor is not supplying hydraulic fluid to the hydraulic actuator and when the first pump motor is unable to collect the hydraulic fluid that has been supplied to the hydraulic motor in the state before the swing deceleration detection section detects the state of the revolving upperstructure being decelerated, the control section controls the first and second switching devices to open to divide the hydraulic fluid within the first hydraulic circuit that flows from the hydraulic motor to the first pump/motor, into the second hydraulic circuit. Thus, the hydraulic fluid discharged from the hydraulic motor in the state that the revolving upperstructure is being decelerated is supplied to each of the first and second pumps/motors. In this case, the displacements of the first and second pumps/motors are respectively increased on the side that the suction pressures of the first and second pumps/motors become higher than the discharge pressures, to operate the first and second pumps/motors as motors, and thus, of the energy owned by the hydraulic fluid discharged from the hydraulic motor in the state that the revolving upperstructure is being decelerated, the energy left without being regenerated by the first pump/motor can be regenerated by the second pump/motor. Therefore, the energy owned by the hydraulic fluid in the state of the revolving upperstructure being decelerated can be regenerated efficiently in comparison with the case that the first pump/motor only regenerates the energy owned by the hydraulic fluid that is discharged from the hydraulic motor in the state of the revolving upperstructure being decelerated. That is, the second pump/motor which is not supplying hydraulic fluid to a hydraulic cylinder is effectively utilized, so that the energy regenerative rate during the swing deceleration can be enhanced.

Advantageous Effect of Invention

In the present invention, when the first pump/motor is unable to collect the hydraulic fluid having been supplied to the hydraulic motor in the state before the swing deceleration detection section detects the state that the revolving upperstructure is being decelerated, the hydraulic fluid in the first hydraulic circuit that flows from the hydraulic motor to the first pump/motor is divided into the second hydraulic circuit, and at the same time, the displacements of the first and second pumps/motors are respectively increased on the side that the suction pressures of the first and second pumps/motors become higher than the discharge pressures, to operate the first and second pumps/motors as motors. As a result, the second pump/motor can regenerate the energy that is left without being regenerated by the first pump/motor in the state of the revolving upperstructure being decelerated, so that the energy owned by the hydraulic fluid that is discharged from the hydraulic motor in the state of the revolving upperstructure being decelerated can be regenerated efficiently. Further, by supplying this regenerated energy to a drive source such as, for example, an engine or the like for use in driving the drive source, the consumption of the fuel required to drive the drive source can be reduced to make the reduction in fuel cost possible. Further, other problems, constructions and effects than those aforementioned will be clarified by the description of the following embodiments.

DESCRIPTION OF EMBODIMENTS

Hereinafter, embodiments of the present invention will be described with reference to the drawings.

First Embodiment

Figure 1:
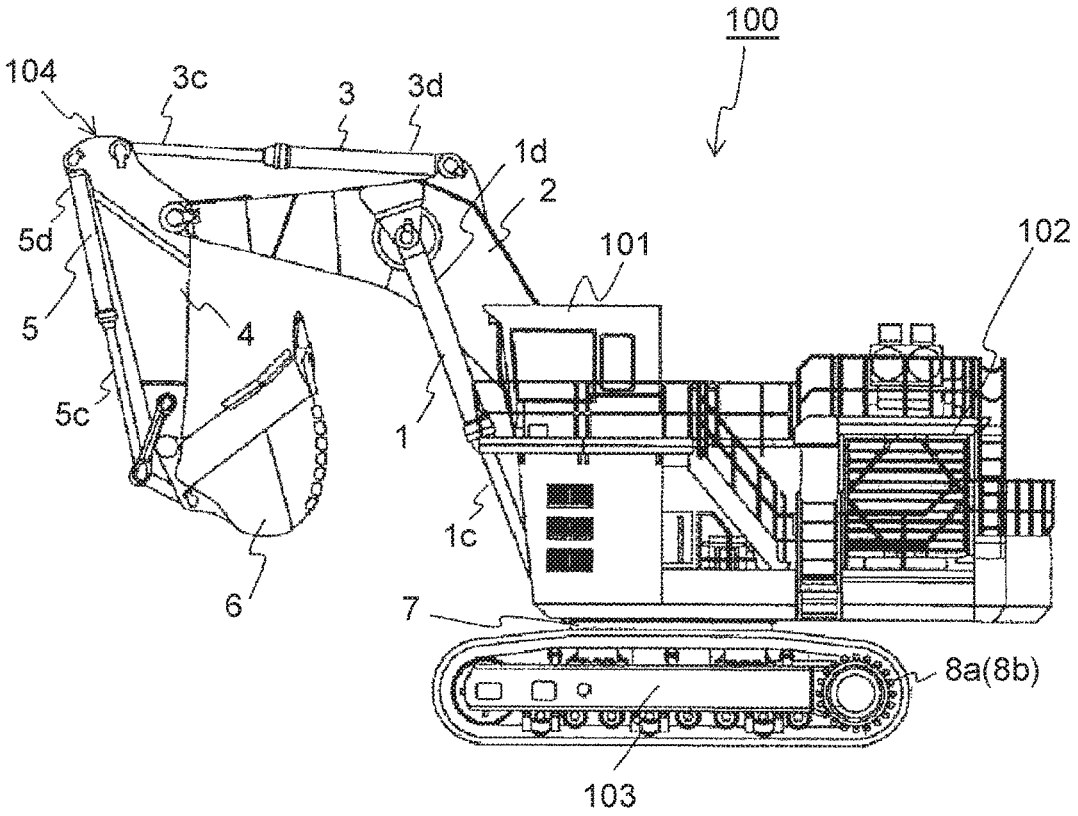
FIG. 1 is a schematic view showing a hydraulic excavator being one example of a work machine according to a first embodiment of the present invention.
Figure 2:
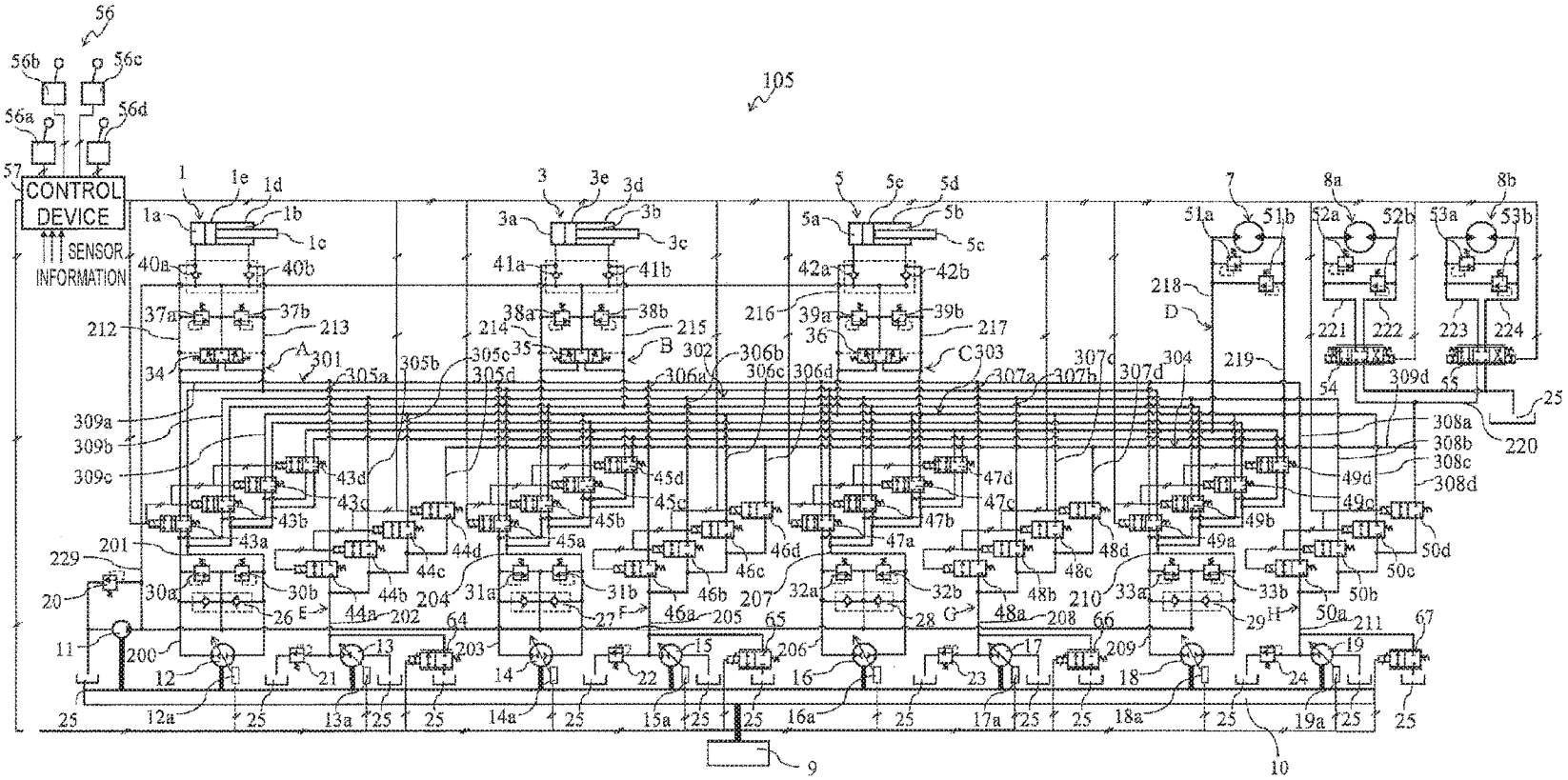
FIG. 2 is a hydraulic circuit diagram showing the system configuration of a hydraulic drive system mounted on the work machine.

FIG. 1 is a schematic view showing a hydraulic excavator being one example of a work machine according to a first embodiment of the present invention. FIG. 2 is a hydraulic circuit diagram showing the system configuration of a hydraulic drive system mounted on the work machine. In the present first embodiment, a plurality of hydraulic pumps/motors is enabled to regenerate the energy owned by the hydraulic fluid that is discharged from a hydraulic motor during a so-called swing deceleration of the hydraulic excavator.

<Entire Configuration>

A hydraulic excavator 100 will be described as an example of a work machine mounting a hydraulic drive system 105 shown in FIG. 2 according to the first embodiment of the present invention. As shown in FIG. 1, the hydraulic excavator 100 is provided with an undercarriage 103 that is equipped with traveling hydraulic motors 8*a*, 8*b* for driving traveling devices of the crawler type arranged on both sides in a right-left direction, and a revolving upperstructure 102 mounted swingably on the undercarriage 103. The revolving upperstructure 102 is provided thereon with a cab 101 into which an operator gets. The revolving upperstructure 102 is able to be swung by a swing hydraulic motor 7 relative to the undercarriage 103.

On its front side, the revolving upperstructure 102 pivotably attaches a base end portion of a front working assembly 104 being a working machine for performing excavation works for example. Here, the front side means the forward direction of the cab 101 (the leftward direction in FIG. 1). The front working assembly 104 is provided with a boom 2 whose base end portion is coupled to the front side of the revolving upperstructure 102 to be pivotable in an upward-downward direction. The boom 2 is operated by the agency of a boom cylinder 1 that is telescopically driven as hydraulic fluid (pressurized oil) is supplied thereto. The boom cylinder 1 is coupled to the revolving upperstructure 102 at an extreme end of a rod 1*c* and is coupled to the boom 2 at a base end portion of a cylinder tube 1*d*.

As shown in FIG. 2, the boom cylinder 1 is provided with a head chamber 1*a* that is located on a base end side of the cylinder tube 1*d* and that, when supplied with hydraulic fluid, presses a piston 1*e* attached to a base end portion of the rod 1*c* to give a load depending on the hydraulic fluid pressure and thereby to move the rod 1*c* for extension. Further, the boom cylinder 1 is provided with a rod chamber 1*b* that is located on a distal end side of the cylinder tube 1*d* and that, when supplied with hydraulic fluid, presses the piston 1*e* to give a load depending on the hydraulic fluid pressure and thereby to move the rod 1*c* for contraction.

Further, a base end portion of an arm 4 is coupled with a distal end portion of the boom 2 pivotably in an upward-downward direction. The arm 4 is operated by the agency of an arm cylinder 3. The arm cylinder 3 is coupled to the arm 4 at a distal end of a rod 3*c* and is coupled to the boom 2 at a cylinder tube 3*d*. As shown in FIG. 2, the arm cylinder 3 is provided with a head chamber 3*a* that is located on a base end side of the cylinder tube 3*d* and that, when supplied with hydraulic fluid, presses a piston 3*e* attached to a base end portion of the rod 3*c* to move the rod 3*c* for extension. Further, the arm cylinder 3 is provided with a rod chamber 3*b* that is located on a distal end side of the cylinder tube 3*d* and that when, supplied with hydraulic fluid, presses the piston 3*e* to move the rod 3*c* for contraction.

A base end portion of a bucket 6 is coupled with a distal end portion of the arm 4 pivotably in an upward-downward direction. The bucket 6 is operated by the agency of a bucket cylinder 5. The bucket cylinder 5 is coupled with the bucket 6 at a distal end of a rod 5*c* and is coupled with the arm 4 at a base end of a cylinder tube 5*d*. Like the arm cylinder 3, the bucket cylinder 5 is provided with a head chamber 5*a* that presses a piston 5*e* to move the rod 5*c* for extension, and a rod chamber 5*b* that presses the piston 5*e* to move the rod 5*c* for contraction.

Incidentally, each of the boom cylinder 1, the arm cylinder 3 and the bucket cylinder 5 is a single-rod hydraulic cylinder that is telescopically operated by hydraulic fluid supplied thereto and that is driven to be extended or contracted in dependence on the supply direction of the hydraulic fluid supplied. The hydraulic drive system 105 is used for driving the swing hydraulic motor 7 and the traveling hydraulic motors 8*a*, 8*b* in addition to the boom cylinder 1, the arm cylinder 3 and the bucket cylinder 5 that constitute the front working assembly 104. The rotational directions and rotational speeds of the swing hydraulic motor 7 and traveling hydraulic motors 8*a*, 8*b* are controlled by being supplied with hydraulic fluid.

As shown in FIG. 2, the hydraulic drive system 105 drives the boom cylinder 1, the arm cylinder 3, the bucket cylinder 5, the swing hydraulic motor 7 and the traveling hydraulic motors 8*a*, 8*b* that are hydraulic actuators, in accordance with the manipulation of an operating lever device 56 as an operating device installed in the cab 101. The extension and contraction operations of the boom cylinder 1, the arm cylinder 3 and the bucket cylinder 5 and the swing operation of the swing hydraulic motor 7, that is, the moving directions and moving speeds thereof are instructed by the operating directions and manipulated variables of respective operating levers 56*a*-56*d* of the operating lever device 56.

The hydraulic drive system 105 is provided with an engine 9 as a power source. The engine 9 is connected with a power transmission device 10 that is composed of, for example, predetermined gears for distributing a power. The power transmission device 10 has connected thereto double-tilting pumps/motors 12, 14, 16, 18, single-tilting pumps 13, 15, 17, 19 and a charge pump 11 that, when the hydraulic fluid pressure in respective closed circuits A-D referred to later goes down, secures the hydraulic fluid pressure in these closed circuits A-D by replenishing hydraulic fluid.

The double-tilting pumps/motors 12, 14, 16, 18 are used in the closed circuits A-D referred to later and are each provided with a double-tilting swash plate mechanism (not shown) of the variable capacity type which is capable of discharging hydraulic fluid in both directions because of a need for changing the discharge direction of hydraulic fluid to control the driving of a hydraulic actuator concerned. To this end, each of the double-tilting pumps/motors 12, 14, 16, 18 has a pair of outflow/inflow ports enabling hydraulic fluid to flow in and out in both directions.

Further, each of the double-tilting pumps/motors 12, 14, 16, 18 has a regulator 12*a*, 14*a*, 16*a*, 18*a* as a flow rate regulating section that adjusts the tilt angle (inclination angle) of a swash plate of the double-tilting type constituting the double-tilting swash plate mechanism to adjust the displacement (the volume of hydraulic fluid the swash plate displaces per rotation) of each of these double-tilting pumps/motors 12, 14, 16, 18. Each of these double-tilting pumps/motors 12, 14, 16, 18, when supplied with high-pressure hydraulic fluid at either of the outflow/inflow ports, is driven to operate as a regenerative hydraulic motor that regenerates the energy owned by the hydraulic fluid. Further, these double-tilting pumps/motors 12, 14, 16, 18 are identical in the maximum discharge capacity and are designed as relatively small hydraulic pumps/motors of the capacity that is capable of discharging hydraulic fluid pressure and hydraulic fluid flow rate corresponding to about the half or so of the maximum manipulated variable of the specified hydraulic actuators respectively connected to these double-tilting pumps/motors 12, 14, 16, 18 in a closed circuit style.

The double-tilting pump/motor 12 is a first pump/motor that is connected to the boom cylinder 1 in the closed circuit style by flow paths 200, 201 enabling hydraulic fluid to flow. The double-tilting pump/motor 14 is a first pump/motor that is connected to the arm cylinder 3 in the closed circuit style by flow paths 203, 204 enabling hydraulic fluid to flow. The double-tilting pump/motor 16 is a first pump/motor that is connected to the bucket cylinder 5 in the closed circuit style by flow paths 206, 207 enabling hydraulic fluid to flow. Further, the double-tilting pump/motor 18 is a second pump/motor that is connected to the swing hydraulic motor 7 in the closed circuit style by flow paths 209, 210 enabling hydraulic fluid to flow.

The single-tilting pumps 13, 15, 17, 19 are used in open circuits E-H that control the supply direction of hydraulic fluid by changeover valves 44*a*-44*d*, 46*a*-46*d*, 48*a*-48*d*, 50*a*-50*d*, and suffice to discharge hydraulic fluid in one direction. Thus, the single-tilting pumps 13, 15, 17, 19 are each provided with a single-tilting swash plate mechanism of the variable capacity type that is capable of discharging hydraulic fluid in one direction only. Therefore, each single-tilting pump 13, 15, 17, 19 is provided with an output port being the outflow side of hydraulic fluid and an input port being the inflow side of hydraulic fluid.

Further, the single-tilting pumps 13, 15, 17, 19 are provided with regulators 13*a*, 15*a*, 17*a*, 19*a* as flow rate adjusting sections that adjust the tilt angle (inclination angles) of the single-tilting swash plates each constituting a single-tilting swash plate mechanism to adjust the displacements of these single-tilting pumps 13, 15, 17, 19.

Further, the single-tilting pumps 13, 15, 17, 19 each continually discharge hydraulic fluid of a flow rate equal to or higher than a predetermined quantity (minimum discharge flow rate) for the need to keep the hydraulic fluid pressure in the open circuits E-H at a predetermined pressure. The respective regulators 12*a*-19*a* adjust the tilt angles of the swash plates of the double-tilting pumps/motors and single-tilting pumps 12-19 corresponding thereto in response to control signals outputted from a control device 57 being a controller to control the discharge directions and discharge flow rates of these double-tilting pumps/motors 12, 14, 16, 18 and the discharge flow rates of the single-tilting pumps 13, 15, 17, 19. Incidentally, the double-tilting pumps/motors and single-tilting pumps 12-19 each suffice to be taken as a variable tilting mechanism such as an inclined axis mechanism but are not each restricted to the swash plate mechanism.

Specifically, the double-tilting pump/motor 12 is connected to the flow path 200 at one of the outflow/inflow ports thereof and is connected to the flow path 201 at the other outflow/inflow port thereof. The flow paths 200, 201 are connected to plural, e.g., four changeover valves 43*a*-43*d*. The changeover valves 43*a*-43*c* are a switching device that switches the supply of hydraulic fluid to the boom cylinder 1, the arm cylinder 3 and the bucket cylinder 5 connected to the double-tilting pump/motor 12 in a closed circuit style, to telescopically drive a required hydraulic actuator of these boom cylinder 1, arm cylinder 3 and bucket cylinder 5. The changeover valve 43*d* switches the supply of hydraulic fluid to the swing hydraulic motor 7 that is connected to the double-tilting pump/motor 12 in the closed circuit style, to switch the swing direction of the swing hydraulic motor 7. The changeover valves 43*a*-43*d* each operate to switch the conduction and cutoff of the flow paths 200, 201 in response to a control signal outputted from the control device 57 and are each held in a cutoff state when the control signal is not outputted from the control device 57. The control device 57 controls the changeover valves 43*a*-43*d* not to be brought into conduction states simultaneously.

The changeover valve 43*a* is connected to the boom cylinder 1 through flow paths 212 and 213. When the changeover valve 43*a* is brought into a conduction state in response to a control signal outputted from the control device 57, the double-tilting pump/motor 12 makes the closed circuit A as a second hydraulic circuit in which the double-tilting pump/motor 12 is connected in a closed circuit style to the boom cylinder 1 through the flow paths 200, 201, the changeover valve 43*a* and the flow paths 212, 213. The changeover valve 43*b* is connected to the arm cylinder 3 through flow paths 214 and 215. When the changeover valve 43*b* is brought into a conduction state in response to a control signal outputted from the control device 57, the double-tilting pump/motor 12 makes the closed circuit B as a second hydraulic circuit in which the double-tilting pump/motor 12 is connected in a closed circuit style to the arm cylinder 3 through the flow paths 200, 201, the changeover valve 43*b* and the flow paths 214, 215.

The changeover valve 43*c* is connected to the bucket cylinder 5 through flow paths 216 and 217. When the changeover valve 43*c* is brought into a conduction state in response to a control signal outputted from the control device 57, the double-tilting pump/motor 12 makes the closed circuit C as a second hydraulic circuit in which the double-tilting pump/motor 12 is connected in a closed circuit style to the bucket cylinder 5 through the flow paths 200, 201, the changeover valve 43*c* and the flow paths 216, 217. The changeover valve 43*d* is connected to the swing hydraulic motor 7 through flow paths 218 and 219. When the changeover valve 43*d* is brought into a conduction state in response to a control signal outputted from the control device 57, the double-tilting pump/motor 12 makes the closed circuit D as a first hydraulic circuit in which the double-tilting pump/motor 12 is connected in a closed circuit style to the swing hydraulic motor 7 through the flow paths 200, 201, the changeover valve 43*d* and the flow paths 218, 219.

The flow path 212 is for connecting the boom cylinder 1 independently to plural changeover valves 44*a*, 46*a*, 48*a* and 50*a* of the open circuits E-H referred to later. The flow path 214 is for connecting the arm cylinder 3 independently to plural changeover valves 44*b*, 46*b*, 48*b* and 50*b* of the open circuits E-H.

The flow path 216 is for connecting the bucket cylinder 5 independently to plural changeover valves 44*c*, 46*c*, 48*c*, 50*c* of the open circuits E-H.

Further, the double-tilting pump/motor 14 is connected to the flow path 203 at one of the outflow/inflow ports thereof and is connected to the flow path 204 at the other outflow/inflow port. The flow paths 203 and 204 have plural, e.g., four changeover valves 45*a*-45*d* connected thereto. The changeover valves 45*a*-45*c* switch the supply of hydraulic fluid to the boom cylinder 1, the arm cylinder 3 and the bucket cylinder 5 connected to the double-tilting pump/motor 14 in the closed circuit style to telescopically drive a required hydraulic actuator of these boom cylinder 1, arm cylinder 3 and bucket cylinder 5. The changeover valve 45*d* switches the supply of hydraulic fluid to the swing hydraulic motor 7 that is connected with the double-tilting pump/motor 14 in a closed circuit style, to switch the swing direction of the swing hydraulic motor 7. The changeover valves 45*a*-45*d* each operate to switch the conduction and cutoff of the flow paths 203, 204 in response to a control signal outputted from the control device 57 and are each held in a cutoff state when the control signal is not outputted from the control device 57. The control device 57 controls the changeover valves 45*a*-45*d* not to be brought into conduction states simultaneously.

The changeover valve 45*a* is connected to the boom cylinder 1 through the flow paths 212 and 213. When the changeover valve 45*a* is brought into a conduction state in response to a control signal outputted from the control device 57, the double-tilting pump/motor 14 is connected annularly, that is, in a closed circuit style to the boom cylinder 1 through the flow paths 203, 204, the changeover valve 45*a* and the flow paths 212, 213. The changeover valve 45*b* is connected to the arm cylinder 3 through the flow paths 214 and 215. When the changeover valve 45*b* is brought into a conduction state in response to a control signal outputted from the control device 57, the double-tilting pump/motor 14 is connected in a closed circuit style to the arm cylinder 3 through the flow paths 203, 204, the changeover valve 45*b* and the flow paths 214, 215.

The changeover valve 45*c* is connected to the bucket cylinder 5 through the flow paths 216 and 217. When the changeover valve 45*c* is brought into a conduction state in response to a control signal outputted from the control device 57, the double-tilting pump/motor 14 is connected in a closed circuit style to the bucket cylinder 5 through the flow paths 203, 204, the changeover valve 45*c* and the flow paths 216, 217. The changeover valve 45*d* is connected to the swing hydraulic motor 7 through the flow paths 218 and 219. When the changeover valve 45*d* is brought into a conduction state in response to a control signal outputted from the control device 57, the double-tilting pump/motor 14 is connected in a closed circuit style to the swing hydraulic motor 7 through the flow paths 203, 204, the changeover valve 45*d* and the flow paths 218, 219.

The double-tilting pump/motor 16 is connected to the flow path 206 at one of the outflow/inflow ports thereof and is connected to the flow path 207 at the other outflow/inflow port. The flow paths 206 and 207 have plural, e.g., four changeover valves 47*a*-47*d* connected thereto. The changeover valves 47*a*-47*c* switch the supply of hydraulic fluid to the boom cylinder 1, the arm cylinder 3 and the bucket cylinder 5 connected to the double-tilting pump/motor 16 in the closed circuit style to telescopically drive a required hydraulic actuator of these boom cylinder 1, arm cylinder 3 and bucket cylinder 5. The changeover valve 47*d* switches the supply of hydraulic fluid to the swing hydraulic motor 7 that is connected to the double-tilting pump/motor 16 in a closed circuit style, to switch the swing direction of the swing hydraulic motor 7. The changeover valves 47*a*-47*d* each operate to switch the conduction and cutoff of the flow paths in response to a control signal outputted from the control device 57 and are each held in a cutoff state when the control signal is not outputted from the control device 57. The control device 57 controls the changeover valves 47*a*-47*d* not to be brought into conduction states simultaneously.

The changeover valve 47*a* is connected to the boom cylinder 1 through the flow paths 212 and 213. When the changeover valve 47*a* is brought into a conduction state in response to a control signal outputted from the control device 57, the double-tilting pump/motor 16 is connected in a closed circuit style to the boom cylinder 1 through the flow paths 206, 207, the changeover valve 47*a* and the flow paths 212, 213. The changeover valve 47*b* is connected to the arm cylinder 3 through the flow paths 214 and 215. When the changeover valve 47*b* is brought into a conduction state in response to a control signal outputted from the control device 57, the double-tilting pump/motor 16 is connected in a closed circuit style to the arm cylinder 3 through the flow paths 206, 207, the changeover valve 47*b* and the flow paths 214, 215.

The changeover valve 47*c* is connected to the bucket cylinder 5 through the flow paths 216 and 217. When the changeover valve 47*c* is brought into a conduction state in response to a control signal outputted from the control device 57, the double-tilting pump/motor 16 is connected in a closed circuit style to the bucket cylinder 5 through the flow paths 206, 207, the changeover valve 47*c* and the flow paths 216, 217. The changeover valve 47*d* is connected to the swing hydraulic motor 7 through the flow paths 218 and 219. When the changeover valve 47*d* is brought into a conduction state in response to a control signal outputted from the control device 57, the double-tilting pump/motor 16 is connected in a closed circuit style to the swing hydraulic motor 7 through the flow paths 206, 207, the changeover valve 47*d* and the flow paths 218, 219.

The double-tilting pump/motor 18 is connected to the flow path 209 at one of the outflow/inflow ports thereof and is connected to the flow path 210 at the other outflow/inflow port. The flow paths 209 and 210 have plural, e.g., four changeover valves 49*a*-49*d* connected thereto. The changeover valves 49*a*-49*c* switch the supply of hydraulic fluid to the boom cylinder 1, the arm cylinder 3 and the bucket cylinder 5 connected to the double-tilting pump/motor 18 in the closed circuit style to telescopically drive a required hydraulic actuator of these boom cylinder 1, arm cylinder 3 and bucket cylinder 5. The changeover valve 49*d* switches the supply of hydraulic fluid to the swing hydraulic motor 7 that is connected to the double-tilting pump/motor 18 in a closed circuit style, to switch the swing direction of the swing hydraulic motor 7. The changeover valves 49*a*-49*d* each operate to switch the conduction and cutoff in response to a control signal outputted from the control device 57 and are each held in a cutoff state when the control signal is not outputted from the control device 57. The control device 57 controls the changeover valves 49*a*-49*d* not to be brought into conduction states simultaneously.

The changeover valve 49*a* is connected to the boom cylinder 1 through the flow paths 212 and 213. When the changeover valve 49*a* is brought into a conduction state in response to a control signal outputted from the control device 57, the double-tilting pump/motor 18 is connected in a closed circuit style to the boom cylinder 1 through the flow paths 209, 210, the changeover valve 49*a* and the flow paths 212, 213. The changeover valve 49*b* is connected to the arm cylinder 3 through the flow paths 214 and 215. When the changeover valve 49*b* is brought into a conduction state in response to a control signal outputted from the control device 57, the double-tilting pump/motor 18 is connected in a closed circuit style to the arm cylinder 3 through the flow paths 209, 210, the changeover valve 49*b* and the flow paths 214, 215.

The changeover valve 49*c* is connected to the bucket cylinder 5 through the flow paths 216 and 217. When the changeover valve 49*c* is brought into a conduction state in response to a control signal outputted from the control device 57, the double-tilting pump/motor 18 is connected in a closed circuit style to the bucket cylinder 5 through the flow paths 209, 210, the changeover valve 49*c* and the flow paths 216, 217. The changeover valve 49*d* is connected to the swing hydraulic motor 7 through the flow paths 218 and 219. When the changeover valve 49*d* is brought into a conduction state in response to a control signal outputted from the control device 57, the double-tilting pump/motor 18 is connected in a closed circuit style to the swing hydraulic motor 7 through the flow paths 209, 210, the changeover valve 49*d* and the flow paths 218, 219.

The output port of the single-tilting pump 13 is connected to plural, e.g., four changeover valves 44*a*-44*d* and the relief valve 21 through the flow path 202. The input port of the single-tilting pump 13 is connected to the hydraulic fluid reservoir 25 to make the open circuit E. The changeover valves 44*a*-44*d* switch the flow path 202 between conduction and cutoff in response to a control signal outputted from the control device 57 to switch a supply destination of the hydraulic fluid outflowing from the single-tilting pump 13 to any of coupling flow paths 301-304 referred to later, and are each held in a cutoff state when the control signal is not outputted from the control device 57. The control device 57 controls the changeover valves 44*a*-44*d* not to be brought into conduction states simultaneously.

The changeover valve 44*a* is connected to the boom cylinder 1 through the coupling flow path 301 and the flow path 212. The coupling flow path 301 is provided to branch from the flow path 212. The changeover valve 44*b* is connected to the arm cylinder 3 through the coupling flow path 302 and the flow path 214. The coupling flow path 302 is provided to branch from the flow path 214. The changeover valve 44*c* is connected to the bucket cylinder 5 through the coupling flow path 303 and the flow path 216. The coupling flow path 303 is provided to branch from the flow path 216. The changeover valve 44*d* is connected through the coupling flow path 304 and the flow path 220 to proportional changeover valves 54 and 55 being control valves that control the supply and discharge of hydraulic fluid to and from the traveling hydraulic motors 8*a*, 8*b*. The relief valve 21 lets the hydraulic fluid in the flow path 202 go into the hydraulic fluid reservoir 25 to protect the flow path 202 and hence, the hydraulic drive system 105 (hydraulic circuit) when the hydraulic fluid pressure in the flow path 202 becomes a predetermined pressure or higher.

Between the flow path 202 and the hydraulic fluid reservoir 25, there is connected a bleed-off valve 64. The bleed-off valve 64 is connected on a conduit branching from the flow path 202 that connects the changeover valves 44*a*-44*d* to the single-tilting pump 13, and leading to the hydraulic fluid reservoir 25. The bleed-off valve 64 controls the flow rate of hydraulic fluid flowing from the flow path 202 to the hydraulic fluid reservoir 25 in response to a control signal outputted from the control device 57. Further, the bleed-off valve 64 becomes a cutoff state when the control signal is not outputted from the control device 57.

The output port of the single-tilting pump 15 is connected to plural, e.g., four changeover valves 46*a*-46*d* and a relief valve 22 through the flow path 205. The input port of the single-tilting pump 15 is connected to the hydraulic fluid reservoir 25 to make the open circuit F. The changeover valves 46*a*-46*d* switch the flow path 205 between conduction and cutoff in response to a control signal outputted from the control device 57 to switch a supply destination of the hydraulic fluid outflowing from the single-tilting pump 15 to any of the coupling flow paths 301-304 and are each held in a cutoff state when the control signal is not outputted from the control device 57. The control device 57 controls the changeover valves 46*a*-46*d* not to be brought into conduction states simultaneously.

The changeover valve 46*a* is connected to the boom cylinder 1 through the coupling flow path 301 and the flow path 212. The changeover valve 46*b* is connected to the arm cylinder 3 through the coupling flow path 302 and the flow path 214. The changeover valve 46*c* is connected to the bucket cylinder 5 through the coupling flow path 303 and the flow path 216. The changeover valve 46*d* is connected to the proportional changeover valves 54, 55 through the coupling flow path 304 and the flow path 220. The relief valve 22 lets the hydraulic fluid in the flow path 205 go into the hydraulic fluid reservoir 25 to protect the flow path 205 when the hydraulic fluid pressure in the flow path 205 becomes a predetermined pressure or higher.

Between the flow path 205 and the hydraulic fluid reservoir 25, there is connected a bleed-off valve 65. The bleed-off valve 65 is connected on a conduit branching from the flow path 205 that connects the changeover valves 46*a*-46*d* to the single-tilting pump 15, and leading to the hydraulic fluid reservoir 25. The bleed-off valve 65 controls the flow rate of the hydraulic fluid flowing from the flow path 205 to the hydraulic fluid reservoir 25, in response to a control signal outputted from the control device 57. The bleed-off valve 65 becomes a cutoff state when the control signal is not outputted from the control device 57.

The output port of the single-tilting pump 17 is connected to plural, e.g., four changeover valves 48*a*-48*d* and a relief valve 23 through a flow path 208. The input port of the single-tilting pump 17 is connected to the hydraulic fluid reservoir 25 to make the open circuit G. The changeover valves 48*a*-48*d* switch the flow path 208 between conduction and cutoff in response to a control signal outputted from the control device 57 to switch a supply destination of the hydraulic fluid outflowing from the single-tilting pump 17 to any of the coupling flow paths 301-304 and are each held in a cutoff state when the control signal is not outputted from the control device 57. The control device 57 controls the changeover valves 48*a*-48*d* not to be brought into conduction states simultaneously.

The changeover valve 48*a* is connected to the boom cylinder 1 through the coupling flow path 301 and the flow path 212. The changeover valve 48*b* is connected to the arm cylinder 3 through the coupling flow path 302 and the flow path 214. The changeover valve 48*c* is connected to the bucket cylinder 5 through the coupling flow path 303 and the flow path 216. The changeover valve 48*d* is connected to the proportional changeover valves 54, 55 through the coupling flow path 304 and the flow path 220. The relief valve 23 lets the hydraulic fluid in the flow path 208 go into the hydraulic fluid reservoir 25 to protect the flow path 208 when the hydraulic fluid pressure in the flow path 208 becomes a predetermined pressure or higher.

Between the flow path 208 and the hydraulic fluid reservoir 25, there is connected a bleed-off valve 66. The bleed-off valve 66 is connected on a conduit branching from the flow path 208 that connects the changeover valves 48*a*-48*d* to the single-tilting pump 17, and leading to the hydraulic fluid reservoir 25. The bleed-off valve 66 controls the flow rate flowing from the flow path 208 to the hydraulic fluid reservoir 25. The bleed-off valve 66 becomes a cutoff state when the operation signal is not outputted from the control device 57.

The output port of the single-tilting pump 19 is connected to plural, e.g., four changeover valves 50*a*-50*d* and a relief valve 24 through a flow path 211. The input port of the single-tilting pump 19 is connected to the hydraulic fluid reservoir 25 to make the open circuit H. The changeover valves 50*a*-50*d* switch the flow path 211 between conduction and cutoff in response to a control signal outputted from the control device 57 to switch a supply destination of the hydraulic fluid outflowing from the single-tilting pump 19 to any of the coupling flow paths 301-304 and are each held in a cutoff state when the control signal is not outputted from the control device 57. The control device 57 controls the changeover valves 50*a*-50*d* not to be brought into conduction states simultaneously.

The changeover valve 50*a* is connected to the boom cylinder 1 through the coupling flow path 301 and the flow path 212. The changeover valve 50*b* is connected to the arm cylinder 3 through the coupling flow path 302 and the flow path 214. The changeover valve 50*c* is connected to the bucket cylinder 5 through the coupling flow path 303 and the flow path 216. The changeover valve 50*d* is connected to the proportional changeover valves 54, 55 through the coupling flow path 304 and the flow path 220. The relief valve 24 lets the hydraulic fluid in the flow path 211 go into the hydraulic fluid reservoir 25 to protect the flow path 211 when the hydraulic fluid pressure in the flow path 211 becomes a predetermined pressure or higher.

The changeover valves 44*a*-44*d*, 46*a*-46*d*, 48*a*-48*d*, 50*a*-50*d* have functions to control the supply of hydraulic fluid from the open circuits E-H to the closed circuits A-D and the division of the hydraulic fluid from the closed circuits A-D to the open circuits E-H.

Between the flow path 211 and the hydraulic fluid reservoir 25, there is connected a bleed-off valve 67. The bleed-off valve 67 is connected on a conduit branching from the flow path 211 that connects the changeover valves 50*a*-50*d* to the single-tilting pump 19, and leading to the hydraulic fluid reservoir 25. The bleed-off valve 67 controls the flow rate of the hydraulic fluid flowing from the flow path 211 to the hydraulic fluid reservoir 25, in response to a control signal outputted from the control device 57. The bleed-off valve 67 becomes a cutoff state when the control signal is not outputted from the control device 57.

The coupling flow path 301 is composed of open-circuit connection flow paths 305*a*-308*a* that are connected to discharge sides from which hydraulic fluids outflow, of at least respective one changeover valves 44*a*, 46*a*, 48*a*, 50*a* included in the plural open circuits E-H, and a closed-circuit connection flow path 309*a* connected to the flow path 212. The coupling flow path 302 is composed of open-circuit connection flow paths 305*b*-308*b* that are connected to discharge sides from which hydraulic fluids outflow, of at least respective one changeover valves 44*b*, 46*b*, 48*b*, 50*b* included in the plural open circuits E-H, and a closed-circuit connection flow path 309*b* connected to the flow path 214. The coupling flow path 303 is composed of open-circuit connection flow paths 305*c*-308*c* that are connected to discharge sides from which hydraulic fluids outflow, of at least respective one changeover valves 44*c*, 46*c*, 48*c*, 50*c* included in the plural open circuits E-H, and a closed-circuit connection flow path 309*c* connected to the flow path 216. The flow path 304 is composed of open-circuit connection flow paths 305*d*-308*d* that are connected to discharge sides from which hydraulic fluids outflow, of at least respective one changeover valves 44*d*, 46*d*, 48*d*, 50*d* included in the plural open circuits E-H, and a connection flow path 309*d*.

The hydraulic drive system 105 is composed of the closed circuits A-D in which the double-tilting pumps/motors 12, 14, 16, 18 and the boom cylinder 1, the arm cylinder 3, the bucket cylinder 5 and the swing hydraulic motor 7 are connected so that one of the outflow/inflow ports of each double-tilting pump/motor 12, 14, 16, 18 is connected through the hydraulic actuator to the other outflow/inflow port in a closed circuit style, and is further composed of the open circuits E-H in which the single-tilting pumps 13, 15, 17, 19 and the changeover valves 44*a*-44*d*, 46*a*-46*d*, 48*a*-48*d*, 50*a*-50*d* are connected so that these single-tilting pumps are connected to the changeover valves 44*a*-44*d*, 46*a*-46*d*, 48*a*-48*d*, 50*a*-50*d* at the output ports respectively and are connected to the hydraulic fluid reservoir 25 at the input ports. These closed circuits A-D and open circuits E-H are made as respective combinations between the closed circuit A and the open circuit E, between the closed circuit B and the open circuit F, between the closed circuit C and the open circuit G, and between the closed circuit D and the open circuit H, so that these closed circuits and open circuits are provided as four circuits each and are paired respectively.

A discharge port of the charge pump 11 is connected through the flow path 229 to a charge relief valve 20 and charge check valves 26-29, 40*a*, 40*b*, 41*a*, 41*b*, 42*a*, 42*b*. A suction port of the charge pump 11 is connected to the hydraulic fluid reservoir 25. The charge relief valve 20 regulates a charge pressure acting on the charge check valves 26-29, 40*a*, 40*b*, 41*a*, 41*b*, 42*a*, 42*b*.

The charge check valves 26 supply the flow paths 200, 201 with hydraulic fluid from the charge pump 11 when the hydraulic fluid pressure in the flow paths 200, 201 falls below the pressure set by the charge relief valve 20. The charge check valves 27 supply the flow paths 203, 204 with hydraulic fluid from the charge pump 11 when the hydraulic fluid pressure in the flow paths 203, 204 falls below the pressure set by the charge relief valve 20. The charge check valves 28 supply the flow paths 206, 207 with hydraulic fluid from the charge pump 11 when the hydraulic fluid pressure in the flow paths 206, 207 falls below the pressure set by the charge relief valve 20. The charge check valves 29 supply the flow paths 209, 210 with hydraulic fluid from the charge pump 11 when the hydraulic fluid pressure in the flow paths 209, 210 falls below the pressure set by the charge relief valve 20.

The charge check valves 40*a*, 40*b* supply the flow paths 212, 213 with the hydraulic fluid from the charge pump 11 when the hydraulic fluid pressure in the flow paths 212, 213 falls below the pressure set by the charge relief valve 20. The charge check valves 41*a*, 41*b* supply the flow paths 214, 215 with the hydraulic fluid from the charge pump 11 when the hydraulic fluid pressure in the flow paths 214, 215 falls below the pressure set by the charge relief valve 20. The charge check valves 42*a*, 42*b* supply the flow paths 216, 217 with the hydraulic fluid from the charge pump 11 when the hydraulic fluid pressure in the flow paths 216, 217 falls below the pressure set by the charge relief valve 20.

Between the flow paths 200 and 201, there are connected a pair of relief valves 30*a* and 30*b*. The relief valves 30*a*, 30*b* let the hydraulic fluids in the flow paths 200, 201 go into the hydraulic fluid reservoir 25 through the charge relief valve 20 to protect the flow paths 200, 201 when the hydraulic fluid pressures in the flow paths 200, 201 become a predetermined pressure or higher. Likewise, a pair of relief valves 31*a* and 31*b* are connected between the flow paths 203 and 204. The relief valves 31*a*, 31*b* let the hydraulic fluids in the flow paths 203, 204 go into the hydraulic fluid reservoir 25 through the charge relief valve 20 to protect the flow paths 203, 204 when the hydraulic fluid pressures in the flow paths 203, 204 become a predetermined pressure or higher.

Also between the flow paths 206 and 207, there are connected a pair of relief valves 32*a* and 32*b*. The relief valves 32*a* and 32*b* let the hydraulic fluids in the flow paths 206, 207 go into the hydraulic fluid reservoir 25 through the charge relief valve 20 to protect the flow paths 206, 207 when the hydraulic fluid pressures in the flow paths 206, 207 become a predetermined pressure or higher. Also between the flow paths 209 and 210, there are connected a pair of relief valves 33*a* and 33*b*. The relief valves 33*a* and 33*b* let the hydraulic fluids in the flow paths 209, 210 go into the hydraulic fluid reservoir 25 through the charge relief valve 20 to protect the flow paths 209, 210 when the hydraulic fluid pressures in the flow paths 209, 210 become a predetermined pressure or higher.

The flow path 212 is connected to the head chamber 1*a* of the boom cylinder 1. The flow path 213 is connected to the rod chamber 1*b* of the boom cylinder 1. Relief valves 37*a* and 37*b* are connected between the flow paths 212 and 213. The relief valves 37*a*, 37*b* let the hydraulic fluids in the flow paths 212, 213 go into the hydraulic fluid reservoir 25 through the charge relief valve 20 to protect the flow paths 212, 213 when the hydraulic fluid pressures in the flow paths 212, 213 become a predetermined pressure or higher. A flushing valve 34 is connected between the flow paths 212 and 213. The flushing valve 34 drains those surplus of the hydraulic fluids (surplus hydraulic fluids) in the flow paths 212, 213 into the hydraulic fluid reservoir 25 through the charge relief valve 20.

The flow path 214 is connected to the head chamber 3*a* of the arm cylinder 3. The flow path 215 is connected to the rod chamber 3*b* of the arm cylinder 3. Relief valves 38*a* and 38*b* are connected between the flow paths 214 and 215. The relief valves 38*a*, 38*b* let the hydraulic fluids in the flow paths 214, 215 go into the hydraulic fluid reservoir 25 through the charge relief valve 20 to protect the flow paths 214, 215 when the hydraulic fluid pressures in the flow paths 214, 215 become a predetermined pressure or higher. A flushing valve 35 is connected between the flow paths 214 and 215. The flushing valve 35 drains those surplus of the hydraulic fluids in the flow paths 214, 215 into the hydraulic fluid reservoir 25 through the charge relief valve 20.

The flow path 216 is connected to the head chamber 5*a* of the bucket cylinder 5. The flow path 217 is connected to the rod chamber 5*b* of the bucket cylinder 5. Relief valves 39*a* and 39*b* are connected between the flow paths 216 and 217. The relief valves 39*a*, 39*b* let the hydraulic fluids in the flow paths 216, 217 go into the hydraulic fluid reservoir 25 through the charge relief valve 20 to protect the flow paths 216, 217 when the hydraulic fluid pressures in the flow paths 216, 217 become a predetermined pressure or higher. A flushing valve 36 is connected between the flow paths 216 and 217. The flushing valve 36 drains those surplus of the hydraulic fluids in the flow paths 216, 217 into the hydraulic fluid reservoir 25 through the charge relief valve 20.

The flow paths 218 and 219 are connected to the swing hydraulic motor 7. Between the flow paths 218 and 219, there are connected relief valves 51*a* and 51*b*. The relief valves 51*a*, 51*b* let the hydraulic fluid in the flow path 218, 219 on a higher pressure side go to the flow path 219, 218 on a lower pressure side to protect the flow paths 218, 219 when the difference in hydraulic fluid pressure between the flow paths 218 and 219 (flow path-to-flow path pressure difference) exceeds a predetermined pressure (hereafter referred to as "set relief pressure").

The proportional changeover valve 54 and the traveling hydraulic motor 8*a* are connected through flow paths 221 and 222. Relief valves 52*a* and 52*b* are connected between the flow paths 221 and 222. The relief valves 52*a*, 52*b* let the hydraulic fluid in the flow path 221, 222 on a higher pressure side go to the flow path 222, 221 on a lower pressure side to protect the flow paths 221 and 222 when the difference in hydraulic fluid pressure between the flow paths 221 and 222 becomes the predetermined set relief pressure or higher. The proportional changeover valve 54 alternately switches the connection destinations of the flow path 220 and the hydraulic fluid reservoir 25 to the flow path 221 and 222 in response to a control signal outputted from the control device 57.

The proportional changeover valve 55 and the traveling hydraulic motor 8*b* are connected through flow paths 223 and 224. Relief valves 53*a* and 53*b* are connected between the flow paths 223 and 224. The relief valves 53*a*, 53*b* let the hydraulic fluid in the flow path 223, 224 on a higher pressure side go to the flow path 224, 223 on a lower pressure side to protect the flow paths 223 and 224 when the difference in hydraulic fluid pressure between the flow paths 223 and 224 becomes the predetermined set relief pressure or higher. The proportional changeover valve 55 alternately switches the connection destinations of the flow paths 220 and the hydraulic fluid reservoir 25 to the flow paths 223 and 224 in response to a control signal outputted from the control device 57.

The control device 57 controls the respective regulators 12*a*-19*a*, the changeover valves 43*a*-50*a*, 43*b*-50*b*, 43*c*-50*c*, 43*d*-50*d* and the proportional changeover valves 54, 55 based on command values that are from the operating lever device 56 and that are indicative of extension/contraction directions and extension/contraction speeds of the boom cylinder 1, the arm cylinder 3 and the bucket cylinder 5, and rotational directions and rotational speeds of the swing hydraulic motor 7 and the traveling hydraulic motors 8*a*, 8*b*, and various sensor information given in the hydraulic drive system 105.

Specifically, the control device 57 performs a pressurized area ratio control that controls a first flow rate that is, for example, the flow rate of the double-tilting pump/motor 12 on the flow path 212 side connected to the head chamber 1*a* and the rod chamber 1*b* of the boom cylinder 1, and a second flow rate that is the flow rate of the single-tilting pump 13 connected to the coupling flow path 301 through the changeover valve 44*a*, so that the ratio of the first flow rate to the second flow rate becomes a predetermined value which is set beforehand in correspondence to the pressurized areas of the head chamber 1*a* and the rod chamber 1*b* of the boom cylinder 1. Likewise, the control device 57 performs the aforementioned pressurized area ratio control with respect to each of the arm cylinder 3 and the bucket cylinder 5 besides the boom cylinder 1.

When driving at least one of the boom cylinder 1, the arm cylinder 3 and the bucket cylinder 5, the control device 57 suitably controls the changeover valves 43*a*-50*a*, 43*b*-50*b*, 43*c*-50*c*, 43*d*-50*d* to supply the at least one being driven of the boom cylinder 1, the arm cylinder 3 and the bucket cylinder 5 with the hydraulic fluid discharged from the double-tilting pumps/motors 12, 14, 16, 18 which are the same in number as the single-tilting pumps 13, 15, 17, 19 corresponding thereto.

The operating lever 56*a* of the operating lever device 56 gives the control device 57 command values indicative of the extension/contraction direction and the extension/contraction speed for the boom cylinder 1. The operating lever 56*b* gives the control device 57 command values indicative of the extension/contraction direction and the extension/contraction speed for the arm cylinder 3, and the operating lever 56*c* gives the control device 57 command values indicative of the extension/contraction direction and the extension/contraction speed for the bucket cylinder 5. The operating lever 56*d* gives the control device 57 command values indicative of the rotational direction and the rotational speed of the swing hydraulic motor 7. Incidentally, operating levers (not shown) are also provided for giving the control device 57 command values indicative of the rotational direction and the rotational speed for the traveling hydraulic motors 8*a*, 8*b*.

<Configuration of Major Part>

Figure 3:
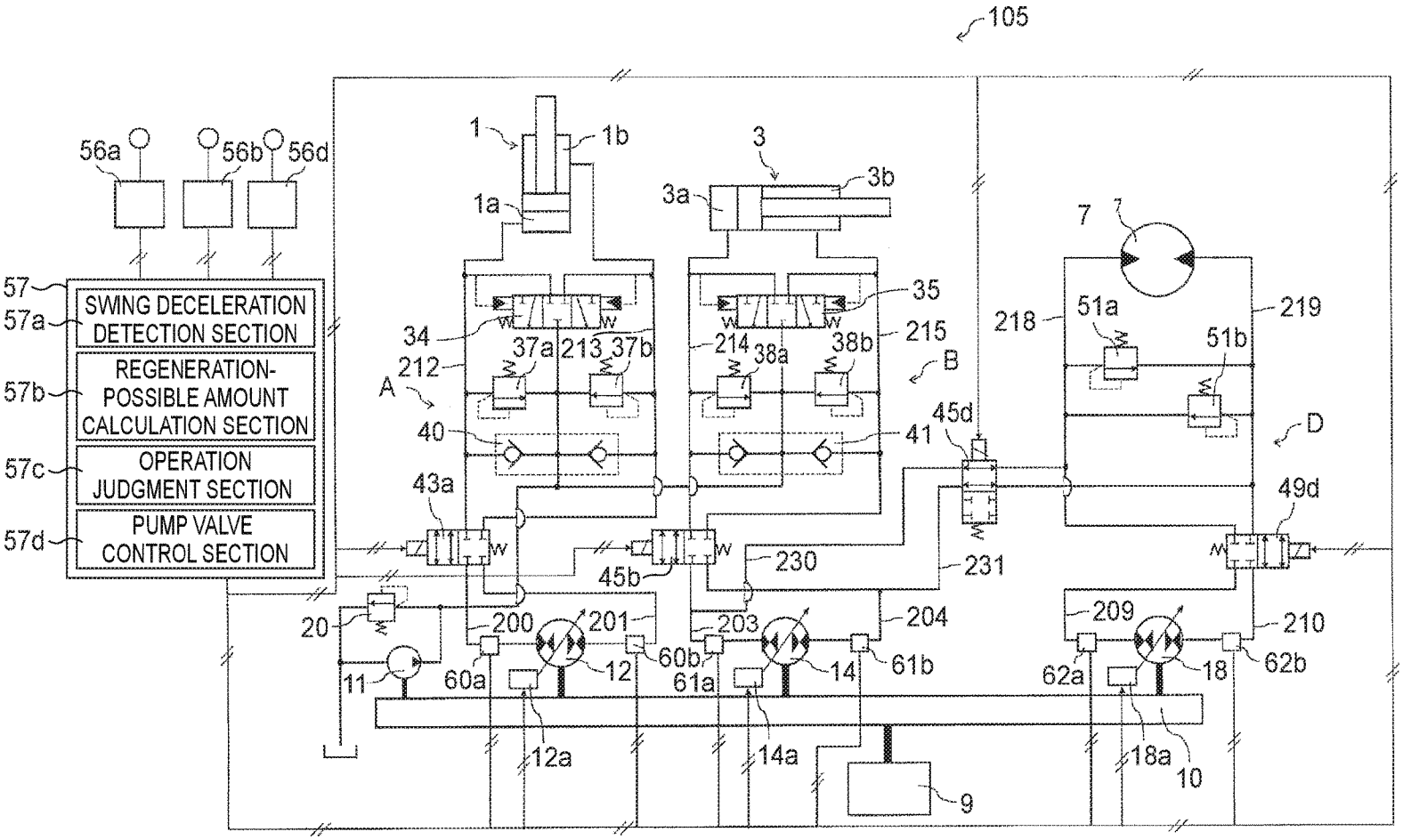
FIG. 3 is a schematic diagram showing a major configuration of the hydraulic drive system.

FIG. 3 is a schematic diagram showing a major configuration of the hydraulic drive system 105. That is, FIG. 3 is a hydraulic circuit diagram that is extracted from FIG. 2 as a major part of the hydraulic circuit according to the foregoing first embodiment. Incidentally, although in FIG. 3, the circuits for the boom cylinder 1 and the arm cylinder 3 are extracted from FIG. 2 and are illustrated, the circuit for the bucket cylinder 5 other than above also takes the same configuration. In FIG. 3, the configurations already described will be given identical reference numerals and will be omitted from description though differing from those in FIG. 2 in detail respects, arrangements and the like.

The hydraulic drive system 105 is configured by the closed circuit A connecting the boom cylinder 1 and the double-tilting pump/motor 12 in the closed circuit style, the closed circuit B connecting the arm cylinder 3 and the double-tilting pump/motor 14 in the closed circuit style, the closed circuit D connecting the swing hydraulic motor 7 and the double-tilting pump/motor 18 in the closed circuit style, a combining flow path 230 connecting the flow path 203 of the closed circuit B with the flow path 218 of the closed circuit D, a combining flow path 231 connecting the flow path 204 of the closed circuit B with the flow path 219 of the closed circuit D, the changeover valve 45*d* connected to these combining flow paths 230, 231, and the control device 57 for controlling the double-tilting pumps/motors 12, 14, 18, the swing hydraulic motor 7 and the changeover valves 43*a*, 45*a*, 45*d*, 49*d*. Incidentally, for the sake of simplicity, description will be omitted regarding a combining flow path (second combining flow path) connecting the flow path 200 of the closed circuit A with the flow path 218 of the closed circuit D, a combining flow path (second combining flow path) connecting the flow path 201 of the closed circuit A with the flow path 219 of the closed circuit D, and a changeover valves (second combining flow path switching device) provided on these combining flow paths.

(Operating Lever Device)

The operating lever device 56, when operated by the operating levers 56*a*, 56*b*, 56*d*, gives the control device 57 driving commands for the boom cylinder 1, the arm cylinder 3 and the swing hydraulic motor 7. The control device 57, upon receiving the driving commands from the operating lever device 56, outputs control signals to the double-tilting pumps/motors 12, 14, 18 by way of respective control signal lines. The double-tilting pumps/motors 12, 14, 18, when receiving the control signals, have the regulators 12*a*, 14*a*, 18*a* controlled, so that the discharge directions and the discharge flow rates of the double-tilting pumps/motors 12, 14, 18 are controlled to control the extension/contraction operations of the boom cylinder 1 and the arm cylinder 3 or the swing operation of the swing hydraulic motor 7. The hydraulic fluids discharged from the double-tilting pumps/motors 14, 18 can be supplied to the swing hydraulic motor 7 after being merged through the combining flow paths 230, 231. Therefore, the hydraulic circuit is configured to be capable of driving the swing hydraulic motor 7 at a high speed by two double-tilting pumps/motors 14, 18.

(Closed-Circuit Configuration)

In the closed circuit A, the displacement of the double-tilting pump/motor 12 is controlled by the regulator 12*a*. The regulator 12*a* is connected to the control device 57 by way of a control signal line. The regulator 12*a* receives from the control device 57 a command signal corresponding to a displacement command value including a discharge direction and controls the displacement of the double-tilting pump/motor 12 in accordance with the command signal. Specifically, the regulator 12*a* receives from the control device 57 a value indicative of a displacement in the form of information with a plus or minus sign, so that the discharge direction is determined by the sign accompanying the displacement.

The extension/contraction direction of the boom cylinder 1 relies on the discharge direction of hydraulic fluid from the double-tilting pump/motor 12. The hydraulic fluid pressure in the head chamber 1*a* and the rod chamber 1*b* of the boom cylinder 1 acts on a pressure-receiving face on the head chamber 1*a* side and a pressure-receiving face on the rod chamber 1*b* side of the piston 1*e* of the boom cylinder 1. The piston 1*e* has loads imposed thereon from the head chamber 1*a* and the rod chamber 1*b*. The difference between the loads acting on the piston 1*e* becomes a driving force to drive the piston 1*e*. The extension/contraction speed of the boom cylinder 1 is determined by the displacement of the double-tilting pump/motor 12 and the rotational speed of the double-tilting pump/motor 12 transmitted from the engine 9 through the power transmission device 10.

The changeover valve 43*a* as a third switching device is connected to the flow paths 200, 201. The changeover valve 43*a* is connected to the control device 57 by way of a control signal line and receives a control signal from the control device 57 to control the conduction and cutoff of the flow paths 200, 201 in response to the control signal. Further, pressure sensors 60*a*, 60*b* as pressure detection sections are connected to the flow paths 200, 201. The pressure sensors 60*a*, 60*b* are connected to the control device 57 by way of control signal lines. The pressure sensor 60*a* is disposed on the flow path which is in the direction to discharge the hydraulic fluid from the double-tilting pump/motor 12 when the displacement with a plus sign is inputted to the regulator 12*a*, that is, on the flow path 200. The pressure sensor 60*b* is disposed on the flow path which is in the direction to discharge the hydraulic fluid from the double-tilting pump/motor 12 when the displacement with a minus value is inputted to the regulator 12*a*, that is, on the flow path 201.

Incidentally, also in the arm cylinder 3 and the swing hydraulic motor 7, the same is true with those elements configuring the closed circuits B and D, and thus, description regarding these closed circuits B and D will be omitted. The flow paths 203, 204 in the closed circuit B and the flow paths 209, 210 in the closed circuit D also have pressure sensors 61*a*, 61*b*, 62*a*, 62*b* connected thereto as pressure detection sections for detecting the hydraulic fluid pressure (discharge/suction pressure) at respective outflow/inflow ports of the double-tilting pumps/motors 14, 18. The changeover valve 49*d* is connected between the flow path 209 and the flow path 218 of the closed circuit D and between the flow path 210 and the flow path 219 of the closed circuit D.

The rotational direction of the swing hydraulic motor 7 is determined by the discharge direction of hydraulic fluid from the double-tilting pump/motor 18. The rotational speed of the swing hydraulic motor 7 is determined by the displacement of the double-tilting pump/motor 18 and the rotational speed of the double-tilting pump/motor 18 transmitted from the engine 9 through the power transmission device 10.

(Control Device)

The control device 57 controls the double-tilting pumps/motors 12, 14, 18 and the changeover valves 43*a*, 45*b*, 45*d*, 49*d* in response to the operations of the operating levers 56*a*, 56*b*, 56*d*. The control device 57 is provided with a swing deceleration detection section 57*a*, a regeneration-possible amount calculation section 57*b*, an operation judgment section 57*c* and a pump valve control section 57*d*. Then, the control device 57 detects by the swing deceleration detection section 57*a* whether the revolving upperstructure 102 is being decelerated, calculates the number of the pumps/motors used for regeneration by the regeneration-possible amount calculation section 57*b*, and judges the presence of any pump/motor of the double-tilting pumps/motors 12, 14 which is not being used for any other driving than the swing driving by the operation judgment section 57*c*.

Specifically, the swing deceleration detection section 57*a* receives through a control signal line a driving command outputted in correspondence to the manipulated variable of the operating lever 56*d* and detects the state that the rotational speed of the swing hydraulic motor 7 is being decelerated, in dependence on the manipulated variable of the operating lever 56*d*. That is, when the operating lever 56*d* is operated to decelerate or discontinue the swing driving of the revolving upperstructure 102, the swing deceleration detection section 57*a* detects that the revolving upperstructure 102 is in the state that the swing is being decelerated.

When swing deceleration regenerative energy is regenerated in the state that the rotational speed of the swing hydraulic motor 7 is being decelerated, that is, at the time of a swing deceleration regenerative control, the regeneration-possible amount calculation section 57*b* calculates a maximum regenerative quantity or amount that is possible to regenerate at the double-tilting pumps/motors 12, 14, 18. Specifically, the regeneration-possible amount calculation section 57*b* is configured to seek pumps that can be used for regeneration, wherein the pumps or the number of pumps that have supplied hydraulic fluid to the swing hydraulic motor 7 are determined based on the manipulated variables of the operating levers 56*a*, 56*b*, 56*d* at the driving of the revolving upperstructure 102 in the state right before the swing deceleration detection section 57*a* detects the state of the revolving upperstructure 102 being decelerated, and from this result, the number of the pumps that of the double-tilting pumps/motors 12, 14, 18, are not being used for the supply of hydraulic fluid to the swing hydraulic motor 7, is determined as the number of the double-tilting pumps/motors that are used for regeneration of the swing deceleration regenerative energy. For example, where hydraulic fluids from two double-tilting pumps/motors 14, 18 have been supplied to the swing hydraulic motor 7, one unit of the double-tilting pump/motor 18 is insufficient in pump capacity and cannot collect the swing deceleration regenerative energy without having a part of the same left, and therefore, the regeneration-possible amount calculation section 57*b* calculates as "two" the number of the double-tilting pumps/motors used for the regeneration of the swing deceleration regenerative energy. Further, where the swing hydraulic motor 7 has been driven by the use of, for example, one unit of the double-tilting pump/motor 18, it is possible to collect for the one unit of the double-tilting pump/motor 18 to collect the swing deceleration regenerative energy, and thus, the regeneration-possible amount calculation section 57*b* calculates as "one" the number of the double-tilting pumps/motors used for the regeneration of the swing deceleration regenerative energy.

The operation judgment section 57*c* receives driving commands outputted in correspondence to the manipulated variables of the operating levers 56*a*, 56*b*, 56*d* through control signal lines and detects, based on the manipulated variables of the operating levers 56*a*, 56*b*, 56*d*, the double-tilting pump/motor 12, 14 that is not supplying hydraulic fluid to the boom cylinder 1 or the arm cylinder 3 except for the swing hydraulic motor 7, in other words, that is not being used in driving any of the boom cylinder 1 and the arm cylinder 3. That is, the operation judgment section 57*c* functions as a pump operation judgment section for judging the operation states of the double-tilting pumps/motors 12, 14.

The pump valve control section 57*d* determines the displacements including the discharge directions of the double-tilting pumps/motors 12, 14, 18 based on the manipulated variables of the respective operating levers 56*a*, 56*b*, 56*d* and the calculation results of the swing deceleration detection section 57*a*, the regeneration-possible amount calculation section 57*b* and the operation judgment section 57*c* and sends command signals that effect control to the determined displacements, to the regulators 12*a*, 14*a*, 18*a* by way of control signal lines. Further, the pump valve control section 57*d* determines the conduction and cutoff of hydraulic fluid at the changeover valves 43*a*, 45*b*, 45*d*, 49*d* and sends control signals that effect control to the conduction or cutoff state determined thereby, to the changeover valves 43*a*, 45*b*, 45*d*, 49*d* by way of control signal lines to control the openings and closings of these changeover valves 43*a*, 45*b*, 45*d*, 49*d*.

In the control device 57 having the functions like this as aforementioned, when the swing deceleration detection section 57*a* detects the state that the revolving upperstructure 102 is being decelerated, the double-tilting pumps/motors used in regenerating the swing deceleration regenerative energy are determined by the calculations at the regeneration-possible amount calculation section 57*b* and the operation judgment section 57*c*. Then, by increasing the displacements of the double-tilting pumps/motors, including at least the double-tilting pump/motor 18 used for regenerating the swing deceleration regenerative energy, on the regenerative side of the swing deceleration regenerative energy, that is, on the side that the double-tilting pumps/motors become high in the suction pressures than the discharge pressures, the pump valve control section 57 makes the double-tilting pumps/motors operate as hydraulic motors, whereby the swing deceleration regenerative control is executed.

(Combining Flow Path)

The combining flow paths 230, 231 branch from the flow paths 203, 204 connected to the double-tilting pump/motor 14 and are connected through the changeover valve 45*d* as the first switching device to the flow paths 218, 219 connected to the double-tilting pump/motor 18. The hydraulic fluid discharged from the double-tilting pump/motor 14 flows from the flow path 203 or the flow path 204 through the combining flow path 230 or the combining flow path 231 and is combined with the hydraulic fluid discharged from the double-tilting pump/motor 18 at the flow path 218 or the flow path 219 to be supplied to the swing hydraulic motor 7. The hydraulic fluid discharged from the swing hydraulic motor 7 is divided from the flow path 218 or the flow path 219 by the combining flow path 230, 231 and is fed to the double-tilting pump/motor 14 through the flow path 203 or the flow path 204 and at the same time, is fed to the double-tilting pump/motor 18 through the flow paths 218, 209 or the flow paths 219, 210.

<Operation>

Next, as the operation of the hydraulic drive system 105 according to the foregoing first embodiment, description will be made regarding the operation of the duration that the boom cylinder 1 is operated from the stop state and that the revolving upperstructure 102 is swung and then, is stopped.

(Stop State)

First of all, description will be made regarding the operation of the hydraulic drive system with the swing hydraulic motor 7 being in the stop state.

The control device 57 receives driving commands corresponding to the respective manipulated variables of the operating levers 56*a*, 56*b*, 56*d* by way of the control signal lines. The operation judgment section 57*c* calculates displacement command values D1-D3 being the operation states of the double-tilting pumps/motors 12, 14, 18 in correspondence to the manipulated variables based on the received driving commands. These displacement command values D1-D3 are determined by the operation judgment section 57*c* in proportion to, for example, the manipulated variables of the respective operating levers 56*a*, 56*b*, 56*d*, wherein setting is made as "0" in the case of the out-of-operation and as "1" or "−1" in the case of the manipulated variable being maximum. The sign (plus or minus) of the displacement command values D1-D3 is set in dependence on the operation direction of the operating levers 56*a*, 56*b*, 56*d*.

The swing deceleration detection section 57*a* calculates the operation speed Dt of the operating lever 56*d* from the following Expression (1).

$$Dt=d|D3|/dt \qquad \text{Expression (1)}$$

That is, the swing deceleration detection section 57*a* judges the revolving upperstructure 102 as being decelerated if the operation speed Dt is a minus value. However, in the stop state, because the operating lever 56*d* is out of operation wherein the displacement command value D3 is "0" and the operation speed Dt becomes "0" or higher, the swing deceleration detection section 57*a* does not judge the revolving upperstructure 102 as being in the state of being decelerated.

The regeneration-possible amount calculation section 57*b* calculates a regeneration-possible amount E. Specifically, the regeneration-possible amount calculation section 57*b* sets the regeneration-possible amount E as "0" since the swing deceleration detection section 57*a* does not judge the revolving upperstructure 102 as being in the state of being decelerated.

The pump valve control section 57*d* outputs command signals based on the displacement command values D1-D3 for the double-tilting pumps/motors 12, 14, 18 to the respective regulators 12*a*, 14*a*, 18*a* by way of the control signal lines. At the same time, the pump valve control section 57*d* outputs a control signal for cutoff operation to the changeover valves 43*a*, 45*b*, 45*d*, 49*d* by way of the control signal lines. Upon receiving the control signal from the pump valve control section 57*d*, the changeover valves 43*a*, 45*b*, 45*d*, 49*d* cut off the respective flow paths 200, 201, 203, 204, 209, 210 and the combining flow paths 230, 231.

Upon receiving command signals based on the displacement command values D1-D3 from the pump valve control section 57*d*, the regulators 12*a*, 14*a*, 18*a* control the displacements of the double-tilting pumps/motors 12, 14, 18 in accordance with the displacement command values D1-D3. At this time, since the operating levers 56*a*, 56*b*, 56*d* are each out of operation and the displacement command values D1-D3 are "0", the double-tilting pumps/motors 12, 14, 18 do not discharge hydraulic fluids.

(Boom Driving+Half Manipulated Variable Swing)

Next, description will be made regarding the operation from the stop state to the swing driving of the swing hydraulic motor 7.

When with the arm operating lever 56*b* being out of operation, the boom operating lever 56*a* is operated and at the same time, the swing operating lever 56*d* is operated by a manipulated variable of the half or less of the maximum manipulated variable, the control device 57 receives driving commands corresponding to the manipulated variables of the respective operating levers 56*a*, 56*b*, 56*d* by way of the signal lines. The operation judgment section 57*c* calculates the displacement command values D1-D3 for the double-tilting pumps/motors 12, 14, 18 in correspondence to the manipulated variables based on the driving commands received. At this time, since the operating lever 56*a* is being operated, the displacement command value D1 is set to a value ranging from "0" to "1" or to "−1". Since the operating lever 56*b* is out of operation, the displacement command value D2 is set to "0". Further, since the operating lever 56*d* is operated in the amount of the half or less of the maximum manipulated variable and is instructing the starting of the swing driving, the displacement command value D3 for the double-tilting pump/motor 18 is set to a value ranging from "0" to "1" or to "−1".

The swing deceleration detection section 57*a* calculates the operation speed Dt of the operating lever 56*d* by Expression (1). Since the operation speed Dt becomes a value equal to "0" or higher when a swing driving start is instructed by the operation of the operating lever 56*d*, the swing deceleration detection section 57*a* does not detect whether the revolving upperstructure 102 is in the state of being decelerated or not. Since the swing deceleration detection section 57*a* does not detect that the revolving upperstructure 102 is in the state of being decelerated, the regeneration-possible amount calculation section 57*b* sets the regeneration-possible amount E to "0".

The pump valve control section 57*d* outputs to the respective regulators 12*a*, 14*a*, 18*a* command signals that are based on the displacement command values D1-D3 set by the operation judgment section 57*c*. At the same time, the pump valve control section 57*d* outputs a control signal to effect an open operation to the changeover valves 43*a*, 49*d* and a control signal to effect a cutoff operation to the changeover valves 45*b*, 45*d*. The changeover valves 45*b*, 45*d* are brought into a cutoff operation upon receiving the control signal from the pump valve control section 57*d* to cutoff the flow paths 203, 204 and the combining flow paths 230, 231. The changeover valves 43*a*, 49*d* are brought into an open operation upon receiving the control signal from the pump valve control section 57*d* to bring the flow paths 200, 201, 209, 201 into the conduction state.

Upon receiving the command signals that are based on the displacement command values D1-D3 from the pump valve control section 57*d*, the regulators 12*a*, 14*a*, 18*a* control the displacements of the double-tilting pumps/motors 12, 14, 18 in accordance with the displacement command values D1-D3. Here, since the displacement command value D2 is "0", the double-tilting pump/motor 14 is controlled not to discharge hydraulic fluid. Since the displacement command values D1, D3 are set respectively to have values each ranging from "0" to "1" or to "−1", the double-tilting pumps/motors 12, 18 are controlled to discharge hydraulic fluids of the flow rates corresponding to these displacement command values D1, D3.

Since the double-tilting pump/motor 14 is not discharging hydraulic fluid and since the changeover valves 45*b*, 45*d* are held to cut off the flow paths 203, 204 and the combining flow paths 230, 231, the arm cylinder 3 becomes a stationary state. Since changeover valve 43*a* opens the flow paths 200, 201 to be held in a conduction state, the conduction of hydraulic fluid becomes possible between the double-tilting pump/motor 12 and the boom cylinder 1 through the flow paths 200, 201 and the flow paths 212, 213. Therefore, the hydraulic fluid discharged from the double-tilting pump/motor 12 is supplied to the head chamber 1*a* or the rod chamber 1*b* of the boom cylinder 1 through the flow path 200, 201 and the flow path 212, 213, whereby the boom cylinder 1 is driven to extend or contract.

Further, since the changeover valve 49*d* opens the flow paths 209, 210 to be held in a conduction state, the conduction of the hydraulic fluid becomes possible between the double-tilting pump/motor 18 and the swing hydraulic motor 7 through the flow paths 209, 210, 218, 219. Thus, the hydraulic fluid discharged from the double-tilting pump/motor 18 is supplied to the swing hydraulic motor 7 through the flow path 209, 210 and the flow path 218, 219, whereby the swing hydraulic motor 7 is drivingly swung. At this time, the rotational speed θ of the swing hydraulic motor 7 is in proportion to the supply quantity per unit time of hydraulic fluid supplied from the double-tilting pump/motor 18 and hence, is in proportion to the displacement command value D3 of the double-tilting pump/motor 18.

(From Half Manipulated Variable Swing to Maximum Manipulated Variable Swing)

Next, description will be described regarding the operation where the operating lever 56*a* for the boom 1 is operated while the operating lever 56*d* for swing is operated beyond the half of the maximum manipulated variable with the operating lever 56*b* for the arm 3 being out of operation.

The operation judgment section 57*c* calculates the displacement command values D1-D3 in correspondence to the manipulated variables that are based on the driving commands received from the operating levers 56*a*, 56*b*, 56*d*. At this time, since the operating lever 56*a* is being operated, the displacement command value D1 is set to a value ranging from "0" to "1" or to "−1". Further, when the operating lever 56*d* is operated beyond the half of the maximum manipulated variable, the displacement command value D3 is set to "1" or "−1". On the other hand, although the operating lever 56*b* is out of operation, the displacement command value D2 is set to a value ranging from "0" to "1" or to "−1" in correspondence to the manipulated variable exceeding the half of the maximum manipulated variable of the operating lever 56*b* to supply hydraulic fluid to the swing hydraulic motor 7 for the purpose of speeding up the swing driving of the swing hydraulic motor 7.

When the operating lever 56*b* is out of operation and when the operating lever 56*d* is operated beyond the half of the maximum manipulated variable, the swing deceleration detection section 57*a* calculates the operation speed Dt by the use of the following Expression (2).

$$Dt=d|D2+D3|/dt \qquad \text{Expression (2)}$$

That is, when the operating lever 56*d* is operated to increase the manipulated variable, the swing deceleration detection section 57*a* sets the operation speed Dt to a value of "0" or larger and does not detect that the revolving upperstructure 102 is being in the deceleration state. Since the swing deceleration detection section 57*a* does not detect that the revolving upperstructure 102 is being in the deceleration state, the regeneration-possible amount calculation section 57*b* calculates the regeneration-possible amount E as "0".

The pump valve control section 57*d* outputs command signals that are based on the displacement command values D1-D3 set by the operation judgment section 57*c*, to the respective regulators 12*a*, 14*a*, 18*a*. At the same time, the pump valve control section 57*d* outputs the control signal to effect an open operation to the changeover valves 43*a*, 45*d*, 49*d* and outputs the control signal to effect a cutoff operation to the changeover valve 45*b*. The changeover valve 45*b* is brought into the cutoff operation upon receiving the control signal from the pump valve control section 57*d* to cut off the flow paths 203, 204. The changeover valves 43*a*, 45*d*, 49*d* are brought into the open operation upon receiving the control signal from the pump valve control section 57*d* to bring the flow paths 200, 201, 209, 210 and the combining flow paths 230, 231 into a conduction state.

Upon receiving command signals that are based on the displacement command values D1-D3 from the pump valve control section 57*d*, the regulators 12*a*, 14*a*, 18*a* control the displacements of the double-tilting pumps/motors 12, 14, 18 in accordance with the displacement command values D1-D3. Since the displacement command value D1 is a value ranging from "0" to "1" or to "−1" depending on the manipulated variable of the operating lever 56*a*, the double-tilting pump/motor 12 is controlled to discharge hydraulic fluid of the flow rate corresponding to the displacement command value D1. Since the displacement command value D2 is a value ranging from "0" to "1" or to "−1" depending on the manipulated variable exceeding the half of the maximum manipulated variable of the operating lever 56*d*, the double-tilting pumps/motor 14 is controlled to discharge hydraulic fluid of the flow rate corresponding to the displacement command value D2. Since the displacement command value D3 is a value being "1" or "−1", the double-tilting pumps/motor 18 is controlled to discharge hydraulic fluid of the maximum discharge flow rate corresponding to the displacement command value D3.

Since the changeover valve 43*a* opens the flow paths 200, 201 to become a conduction state, the conduction of hydraulic fluid becomes possible between the double-tilting pump/motor 12 and the boom cylinder 1 through the flow paths 200, 201 and the flow paths 212, 213. Thus, the hydraulic fluid discharged from the double-tilting pumps/motor 12 is supplied to the head chamber 1*a* or the rod chamber 1*b* of the boom cylinder 1 through the flow path 200, 201 and the flow path 212, 213, whereby the boom cylinder 1 is driven to extend or contract.

Further, the changeover valves 45*d*, 49*d* respectively open the combining flow paths 230, 231 and the flow paths 209, 210 to become a conduction state, the conduction of hydraulic fluid becomes possible between the double-tilting pump/motor 14 and the swing hydraulic motor 7 through the flow paths 203, 204, the combining flow paths 230, 231 and the flow paths 218, 219. Further, the conduction of hydraulic fluid becomes possible between the double-tilting pump/motor 18 and the swing hydraulic motor 7 through the flow paths 209, 210 and the flow paths 218, 219. These double-tilting pumps/motors 14, 18 discharge hydraulic fluids of the flow rates corresponding to the displacement command values D2, D3.

The hydraulic fluid discharged from the double-tilting pump/motor 14 flows through the flow path 203, 204 and the combining flow path 230, 231 to be merged on the flow path 218, 219 with the hydraulic fluid discharged from the double-tilting pump/motor 18 to be supplied to the swing hydraulic motor 7 through the flow path 218, 219, whereby the swing hydraulic motor 7 is drivingly swung. At this time, since the hydraulic fluids respectively discharged from these double-tilting pumps/motors 14, 18 are supplied to the swing hydraulic motor 7, the rotational speed θ of the swing hydraulic motor 7 is in proportion to the sum (D2+D3) of the displacement command values D2, D3 of the double-tilting pumps/motors 14, 18.

(From Maximum Manipulated Variable Swing to Swing Deceleration Regeneration)

Next, description will be made regarding the operation wherein the swing hydraulic motor 7 in the swinging state is decelerated and stopped.

When the operating lever 56*a* is operated and the operating lever 56*d* is brought from the maximum manipulated variable into the out-of-operation state with the operating lever 56*b* being out of operation, the swing deceleration detection section 57*a* sets the operation speed Dt by the use of Expression (2). That is, when the operating lever 56*d* is operated in the direction to decrease the manipulated variable, the swing deceleration detection section 57*a* sets the operation speed Dt to a minus value being "0" or larger and detects whether the revolving upperstructure 102 is in the state of being decelerated or not. Since the swing deceleration detection section 57*a* detects that the revolving upperstructure 102 is in the state of being decelerated, the regeneration-possible amount calculation section 57*b* detects the hydraulic fluid pressures at the respective outflow and inflow ports of the double-tilting pumps/motors 12, 14, 18 through the pressure sensors 60*a*, 60*b*, 61*a*, 61*b*, 62*a*, 62*b* and calculates the regeneration-possible amount E from the following Expression (3).

$$E=(Pa-Pb)\times D1/(2\pi) \qquad \text{Expression (3)}$$

Symbols Pa and Pb in the Expression (3) denote pressure values measured by the pressure sensors 60*a*, 60*b*. The regeneration-possible amount E represents a load torque (Nm) that acts on the engine 9. Incidentally, without being calculated using the Expression (3) based on the measured values of the pressure sensors 60*a*, 60*b* connected to the respective flow paths 200, 201, the regeneration-possible amount E may be calculated based on, for example, a fuel injection amount that is set by an engine controller (not shown) for controlling the driving of the engine 9.

The pump valve control section 57 executes the following arithmetic processing in performing the swing deceleration regenerative control.

In the beginning, a swing deceleration regenerative torque Es is calculated by the following Expression (4) from the pressure values detected by the pressure sensors 62*a*, 62*b*.

$$Es=(Pe-Pf)\times Dm/2\pi \qquad \text{Expression (4)}$$

This swing deceleration regenerative torque Es corresponds to the inertial energy attributed to the swinging, that is, to the swing deceleration regenerative energy becoming the target for regeneration and will hereafter be indicated as swing regenerative energy Es as a matter of convenience. Incidentally, symbol Dm denotes the displacement of the swing hydraulic motor 7.

Next, the swing regenerative energy Es and the regeneration-possible amount E are compared in terms of magnitude. If as a result of this comparison, the regeneration-possible amount E is equal to or higher than the swing regenerative energy Es, it is possible that the swing regenerative energy Es can be all regenerated and that the whole of this regenerated energy can be used for driving the engine 9 as drive energy for the boom cylinder 1, and therefore, the swing regenerative principle control is executed. On the other hand, if the swing regenerative energy Es is larger than the regeneration-possible amount E, the regeneration of the swing regenerative energy Es does not make it possible to absorb as drive energy for the boom cylinder 1 energy that exceeds the regeneration-possible amount E, resulting in a fault such as the overspeeding of the engine 9 or the like, and therefore, the swing regenerative deceleration control is not executed.

Next, the aforementioned swing regenerative energy Es and the energy Esmax that is possible for the swing double-tilting pump/motor 18 to regenerate are compared in terms of magnitude. If this comparison results in Es≤Esmax, the swing regenerative energy Es can be regenerated by the double-tilting pump/motor 18 only. If Es>Esmax results to the contrary, it results from this that as will be described later, the swing regenerative energy Es is regenerated by using the double-tilting pump/motor 14 in addition to the double-tilting pump/motor 18. Therefore, in the case of Es≤Esmax, a closing signal is outputted to the changeover valve 45*d* for flow-combination use, whereby the return oil from the swing hydraulic motor 7 is returned only to the double-tilting pump/motor 18. On the other hand, in the case of Es>Esmax, an open signal is outputted to the changeover valve 45*d* for flow-combination use, whereby the return oil from the swing hydraulic motor 7 flows to two of the double-tilting pumps/motors 14, 18.

Incidentally, since the boom operating lever 56*a* is being operated and the arm operating lever 56*b* is not being operated, an open signal is outputted to the changeover valve 43*a*, and a closing signal is outputted to the changeover valve 45*b*. Since the double-tilting pump/motor 18 is used for regeneration, an open signal is outputted to the changeover valve 49*d*.

Then, the displacement command values D2, D3 for the double-tilting pumps/motors 14, 18 are calculated to be used at the time of regeneration. First, in order that during the regeneration, the swing hydraulic motor 7 is decelerated at a uniform deceleration rate without causing the pressures Pe, Pf in the swing system flow paths 209, 210, 218, 219 to change as much as possible, the return speed of the displacements for the double-tilting pumps/motors 14, 18 is calculated by the following Expression (5).

$$dDe=(Pe-Pf)\times Dm\times G/2\pi/J \qquad \text{Expression (5)}$$

In this Expression (5), symbol Dm denotes the displacement of the swing hydraulic motor 7, G denotes a gear ratio of the power transmission device 10, and J denotes an inertia moment of the revolving upperstructure 102 and the front working assembly 104. Symbol J denotes an inertia moment of the revolving upperstructure 102 and the front working assembly 104. Although varying in dependence on the posture of the front working assembly 104, the value of J may be taken as, for example, the value at the time of a maximum reach position where the inertia moment becomes maximum, or as an average value or the like that is obtained through experiments in various postures.

Accordingly, where symbol D3*f* is taken as a displacement command value to the double-tilting pump/motor 18 immediately before the starting of the swing deceleration regenerative control, the displacement command value to the double-tilting pump/motor 18 during the swing deceleration regenerative control becomes to be derived from the following Expression (6), and this command value D3 is outputted to the regulator 18*a*.

$$D3=D3f-dDe\times t \qquad \text{Expression (6)}$$

In this Expression (6), symbol t denotes the time from the starting of the swing deceleration regenerative control. Incidentally, the displacement command value D1 to the double-tilting pump/motor 12 for the boom cylinder 1 is calculated, as mentioned earlier, by the operation judgment section 57*c* as a value corresponding to the manipulated variable of the boom operating lever 56*a* and is outputted to the regulator 12*a*.

Further, in the case that the regenerative energy Es cannot be regenerated by the double-tilting pump/motor 18 only, the double-tilting pump/motor 14 is also used for regeneration, as mentioned before. Thus, when after the displacement command value D3 to the double-tilting pump/motor 18 becomes "0", the displacement command value to the double-tilting pump/motor 14 immediately before the starting of the swing deceleration regenerative control is taken as D2*f*, the displacement command value to the double-tilting pump/motor 14 during the swing deceleration regenerative control becomes as expressed in the following Expression (7), and this command value D2 is outputted to the regulator 14*a*.

$$D2=D2f-dDe\times(t-t0) \qquad \text{Expression (7)}$$

In the Expression (7), symbol t0 denotes the time when the displacement of D3 becomes "0", and until this time, D2*f* is outputted as a command value. As clear from the Expression (6) and the Expression (7), the displacement command values D2, D3 to the double-tilting pumps/motors 14, 18 are decreased gradually in dependence on dDe. The regulators 14*a*, 18*a* of the double-tilting pumps/motors 14, 18 input thereto the displacement command values D2, D3 from the pump valve control section 57*d* and gradually decrease the displacements in accordance with the input command values D2, D3. On the other hand, the revolving upperstructure 102 continues the swing operation by its inertia, and thus, the pressure in the discharge side flow path of the swing hydraulic motor 7 goes to rise with the decrease of the displacement. The double-tilting pumps/motors 14, 18 each acquire the rotational power by the highly pressurized hydraulic fluid in the discharge side flow path of the swing hydraulic motor 7 and each operate as a motor.

In the swing deceleration regenerative control, the rotational powers given to the double-tilting pumps/motors 14, 18 are transmitted to the power transmission device 10 side. In this way, the inertia energy during the swing deceleration of the revolving upperstructure 102, that is, the swing regenerative energy Es is supplied to the power transmission device 10 through the double-tilting pumps/motors 14, 18, so that the engine 9, even when decreased in output power by that amount so supplied, is able to drive the double-tilting pump/motor 12 used for the boom.

Further, as mentioned earlier, even when the swing regenerative energy Es is equal to or higher than the maximum value Esmax that can be regenerated only by the double-tilting pump/motor 18, the changeover valve 45*d* for flow combination is given the open signal outputted thereto to be brought into a conduction state, and this makes it possible for the pressurized oil discharged from the swing hydraulic motor 7 to flow also to the double-tilting pump/motor 14, so that a larger amount of energy can be regenerated.

Next, operation will be described regarding the operation wherein with the operating levers 56*a*, 56*b* being each out of operation, the operating lever 56*d* is operated from the maximum manipulated variable into the out-of-operation.

Since the operating lever 56*a* is out of operation, the operation judgment section 57*c* sets the displacement command value D1 to "0". The swing deceleration detection section 57*a* sets the operation speed Dt of the operating lever 56*d* by the use of Expression (2). At this time, when the operating lever 56*d* is operated in a direction to decrease the manipulated variable, the swing deceleration detection section 57*a* detects that the revolving upperstructure 102 is in the state of being decelerated, so as to set the operation speed Dt to a minus value.

On the other hand, since each of the operating levers 56*a*, 56*b* is out of operation and since there does not exist any hydraulic actuator which can be driven by the use of the regenerated energy, the displacement command values D1, D2 become "0". Then, the regeneration-possible amount E is set by Expression (3) to "0". In the pump valve control section 57*d*, the swing deceleration regenerative control is not executed since the regeneration-possible amount E is "0". Incidentally, the pump valve control section 57*d* outputs to the regulators 12*a*, 14*a*, 18*a* the displacement command values D2, D3 that are each "0" for the respective closed-circuit pumps/motors 12, 14, 18. At the same time, the pump valve control section 57*d* outputs a control signal to effect a cutoff operation to each of the changeover valves 43*a*, 45*b*, 45*d*, 49*d*.

In this case, since the double-tilting pumps/motors 12, 14, 18 do not discharge hydraulic fluid and since the changeover valves 43*a*, 45*b*, 45*d*, 49*d* are in the cutoff state, the boom cylinder 1 and the arm cylinder 3 are not operated and become a stationary state. On the other hand, since the changeover valve 49*d* cuts off the flow paths 209, 210 from the flow paths 218, 219, the hydraulic fluid discharged from the swing hydraulic motor 7 is not supplied to the double-tilting pump/motor 18. At this time, the swing hydraulic motor 7 is rotated by the inertias of the revolving upperstructure 102 and the front working assembly 104, and this rotation by the inertias causes the hydraulic fluid to be discharged to the flow path 218 or to the flow path 219, and the pressure of the hydraulic fluid rises up to a set relief pressure of the relief valves 51*a*, 51*b*. When the pressure of the hydraulic fluid discharged from the swing hydraulic motor 7 rises up to the set relief pressure, the relief valve 51*a*, 51*b* is operated to open and becomes the conduction state. For example, when the swing hydraulic motor 7 rotated by the inertia forces of the revolving upperstructure 102 and the front working assembly 104 discharges hydraulic fluid to the flow path 218, the hydraulic pressure in the flow path 218 goes up to the set relief pressure, and the open operation of the relief valve 51*a* causes the hydraulic fluid in the flow path 218 to flow to the flow path 219 through the relief valve 51*a*. The hydraulic fluid flowing to the flow path 219 is supplied to the swing hydraulic motor 7. As a result, due to the generation of a deceleration torque that depends on the set relief pressure of the relief valve 51*a*, the swing hydraulic motor 7 gradually reduces the rotational speed and finally becomes a stop state. No regeneration is performed in this operation.

(From Half Manipulated Variable Swing to Out-of-Operation)

Further, description will be made regarding the operation in the case where a swing deceleration is instructed by bringing the operating lever 56*d* from a manipulated variable corresponding to the half of the maximum manipulated variable into the out-of-operation with the operating lever 56*b* being out of operation and with the operating lever 56*a* being operated.

In this situation, since the double-tilting pump/motor 12 is being driven and the changeover valves 43*a* places the flow paths 200, 201 in a conduction state, the boom cylinder 1 is being driven. On the other hand, the double-tilting pump/motor 14 is not being driven and the changeover valve 45*b* cuts off the flow paths 203, 204, and thus, the arm cylinder 3 remains stopped.

Also in this case, the control device 57 performs the calculations by Expression (2) to Expression (5). When the value of Expression (2) is negative and when the regeneration-possible amount E is larger than the swing regenerative energy Es, the pump valve control section 57*d* sets a displacement return speed dDe by the use of Expression (5) and again sets the displacement command value D3 for the double-tilting pump/motor 18 based on the set displacement return speed dDe. At the same time, the pump valve control section 57*d* outputs a control signal to effect an open operation to the changeover valve 49*d* and brings the flow paths 209, 210 into a conduction state.

As a result, where the regeneration can be done by the double-tilting pump/motor 18 only because the swing deceleration regenerative energy owned by the hydraulic fluid that is discharged from the swing hydraulic motor 7 with the revolving upperstructure 102 being decelerated is small, the hydraulic fluid discharged from the swing hydraulic motor 7 is fed from the flow path 218, 219 only to the double-tilting pump/motor 18 through the flow path 209, 210, whereby the regeneration operation is performed by the double-tilting pump/motor 18 only. Due to the generation of a deceleration torque that depends on the set relief pressure of the relief valve 51*a* or the relief valve 51*b*, the swing hydraulic motor 7 gradually reduces the rotational speed and finally comes to a stop state.

(From Three-Combined Operation to Regeneration)

Further, description will be made regarding the operation in the case where a swing deceleration is instructed by operating the operating lever 56*d* from the operation state to the out-of-operation with the operating levers 56*a*, 56*b* being each operated.

In this situation, since the double-tilting pump/motor 12 is being driven and the changeover valves 43*a* places the flow paths 200, 201 in a conduction state, the boom cylinder 1 is being driven. Further, the double-tilting pump/motor 14 is also being driven and the changeover valves 45*b* places the flow paths 203, 204 in a conduction state, and thus, the arm cylinder 3 is being driven.

In this case, the control device 57 performs the calculations by Expressions (1) and (3)-(6). Where the value of Expression (1) is negative and where the regeneration-possible amount E is larger than the swing regenerative energy Es, the pump valve control section 57*d* sets the displacement return speed dDe by the use of Expression (5) and sets the displacement command value D3 for the double-tilting pump/motor 18 based on the set displacement return speed dDe. At the same time, the pump valve control section 57*d* outputs a control signal to effect an open operation to the changeover valve 49*d* and brings the flow paths 209, 210 into conduction state.

At this time, the boom cylinder is driven by supplying hydraulic fluid from the double-tilting pump/motor 12 to the boom cylinder 1, and the arm cylinder 3 is driven by supplying hydraulic fluid from the double-tilting pump/motor 14 to the arm cylinder 3. That is, these double-tilting pumps/motors 12, 14 are being respectively used to drive those except for the swing hydraulic motor 7. Therefore, where the swing deceleration regenerative energy is regenerated by the use of the double-tilting pump/motor 12, 14, an influences is given to the drive operation of the boom cylinder 1 or the arm cylinder 3 by the double-tilting pump/motor 12, 14, and therefore, the regeneration by the double-tilting pump/motor 12, 14 is not performed. That is, the hydraulic fluid discharged from the swing hydraulic motor 7 is fed from the flow path 218, 219 only to the double-tilting pump/motor 18 through the flow path 209, 210, whereby the swing deceleration regenerative energy Es is regenerated by the double-tilting pump/motor 18 only. Due to the generation of a deceleration torque that depends on the set relief pressure of the relief valve 51*a* or the relief valve 51*b*, the swing hydraulic motor 7 gradually reduces the rotational speed and finally becomes a stop state.

<Operation and Effects>

Figure 4:
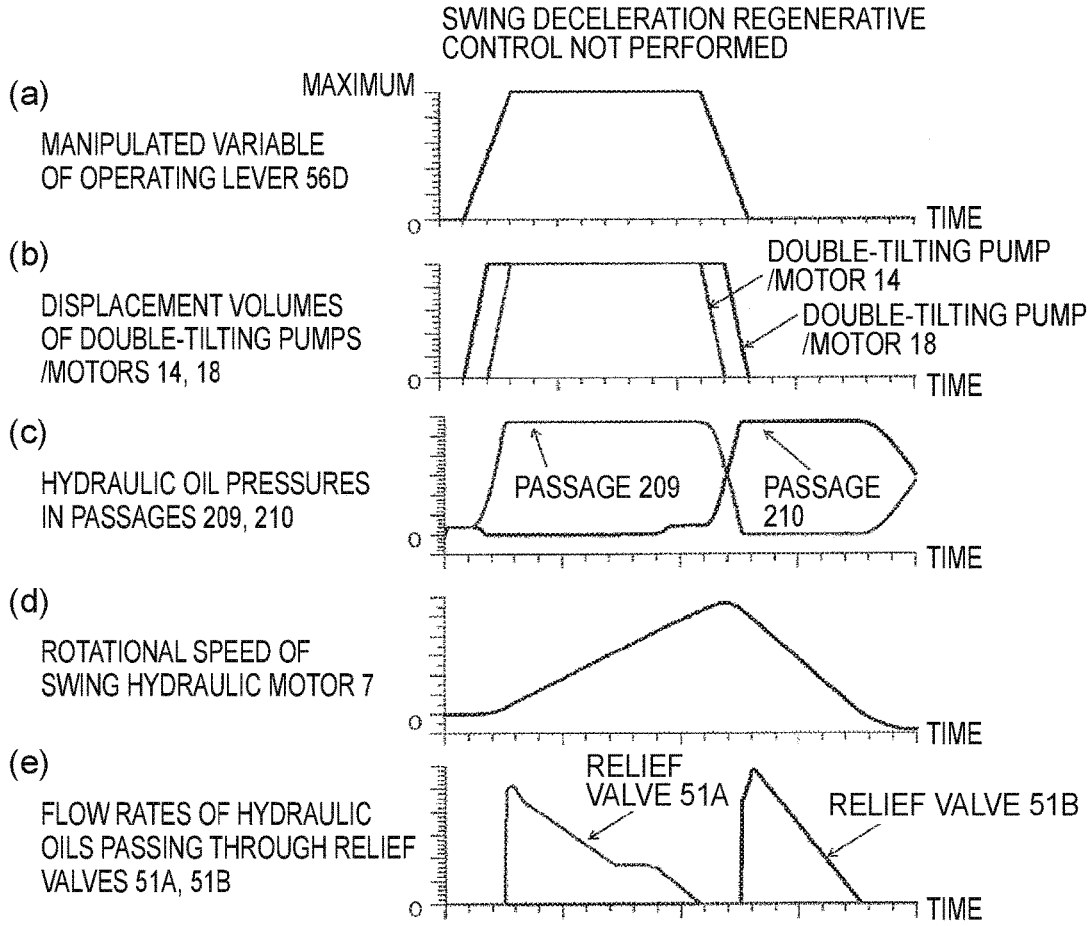
FIG. 4 shows time charts showing the case where a swing deceleration regenerative control is not performed by the hydraulic drive system, wherein (a) represents the manipulated variable of an operating lever 56*d*, (b) represents the displacements of double-tilting pumps/motors 14, 18, (c) represents the hydraulic fluid pressures in flow paths 209, 210, (d) represents the rotational speed of a swing hydraulic motor 7, and (e) represents the flow quantities of hydraulic fluids that pass through relief valves 51*a*, 51*b*.
Figure 5:
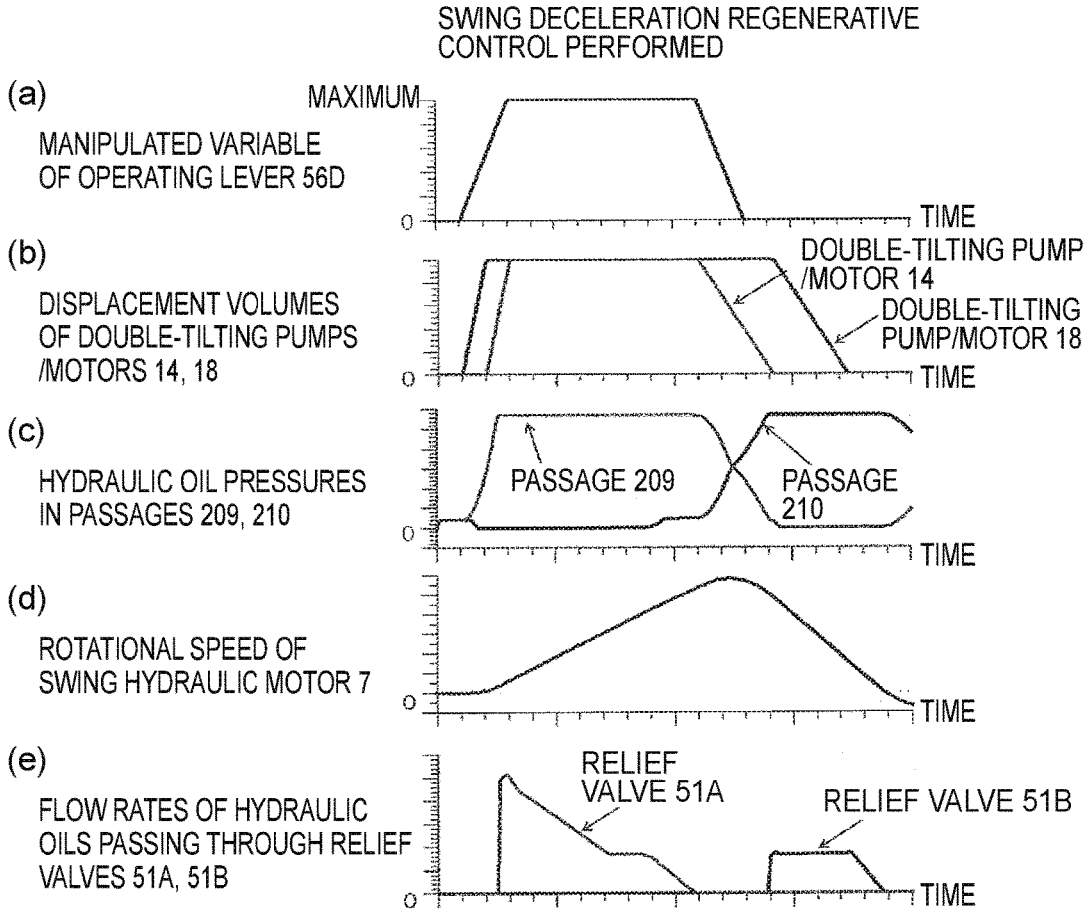
FIG. 5 shows time charts showing the swing deceleration regenerative control by the hydraulic drive system, wherein (a) represents the manipulated variable of the operating lever 56*d*, (b) represents the displacements of the double-tilting pumps/motors 14, 18, (c) represents the hydraulic fluid pressures in the flow paths 209, 210, (d) represents the rotational speed of the swing hydraulic motor 7, and (e) represents the flow rates of hydraulic fluids that pass through the relief valves 51*a*, 51*b*.

Description will described regarding effects in the boom-up operation of the hydraulic excavator 100 according to the foregoing first embodiment. FIG. 4 and FIG. 5 show one example of results obtained where one-dimensional numerical analysis is carried out with respect to the hydraulic circuit and the swing generative control according to the first embodiment.

FIG. 4 show time charts representing the case that the swing deceleration generative control is not performed in the hydraulic drive system 105, wherein (a) shows the manipulated variable of the operating lever 56*d* in the case that from the stop state, the revolving upperstructure 102 is drivingly swung and then is stopped, (b) shows the displacements of the double-tilting pumps/motors 14, 18 outputted by the pump valve control section 57*d*, (c) shows the hydraulic fluid pressures in the flow paths 209, 210, (d) shows the rotational speed of the swing hydraulic motor 7, and (e) shows the flow rates of the hydraulic fluids that pass through the relief valves 51*a*, 51*b*.

In the hydraulic drive system 105 shown in FIG. 3, when a swing deceleration is instructed by operating the operating lever 56*d* from the maximum manipulated variable to the out-of-operation as shown in FIG. 4(*a*) with the operating lever 56*a* being operated and with the operating lever 56*b* being out of operation, the double-tilting pump/motor 12 is driving the boom cylinder 1 since the operating lever 56*a* is being operated. As shown in FIG. 4(*b*), the double-tilting pumps/motors 14, 18 are discharging hydraulic fluids of the flow rates corresponding to the displacement command values D2, D3, and the hydraulic fluids discharged from these double-tilting pumps/motors 14, 18 are merged in the flow path 218, 219 to be supplied to the swing hydraulic motor 7. The swing hydraulic motor 7 is driven at the rotational speed shown in FIG. 4(*d*) and is so operated as to be stopped after being decelerated from the swing driving state corresponding to the maximum operation mount of the operating lever 56*d*.

In the course of the operation like this, in the state that the revolving upperstructure 102 is being decelerated, the hydraulic fluid is discharged from the swing hydraulic motor 7 being rotated by the inertia forces of the revolving upperstructure 102 and the front working assembly 104 to the flow path 218, 219 having been cut off by the changeover valve 49*d*, and this causes the hydraulic pressure in the flow path 218, 219 to rise and reach the set relief pressure of the relief valve 51*a*, 51*b*, as shown in FIG. 4(*c*). Because the set relief pressure is generated on the side to which the swing hydraulic motor 7 discharges the hydraulic fluid, to generate a deceleration torque, the swing hydraulic motor 7 goes to be decelerated and is stopped, as shown in FIG. 4(*d*). During this time, all of the flow quantity of the hydraulic fluid discharged from the swing hydraulic motor 7 passes through the relief valve 51*a* or the relief valve 51*b*, as shown in FIG. 4(*e*), and this results in discarding the swing deceleration regenerative energy owned by the hydraulic fluid.

Further, where the regeneration-possible amount E is smaller than the swing deceleration regenerative torque Es and where the swing deceleration regenerative energy regenerated by the double-tilting pumps/motors 14, 18 is larger than the load acting on the engine 9, there is a risk that the regeneration of the swing deceleration regenerative energy by the double-tilting pumps/motors 14, 18 causes the engine 9 to be accelerated and hence, there arises an anxiety that the rotational speed of the engine 9 is excessively accelerated to reach breakdown or the like.

To avoid this, in the hydraulic drive system 105 according to the foregoing first embodiment, the configuration is taken that where the regeneration-possible amount E is smaller than the swing deceleration regenerative torque Es, the displacement command values D2, D3 are each set to "0" in dependence on the manipulated variable of the operating lever 56*d* so as not to regenerate the swing deceleration regenerative energy, whereby the risk that the regeneration of the swing deceleration regenerative energy by the double-tilting pumps/motors 14, 18 causes the engine 9 to be accelerated can be precluded and whereby the breakdown or the like of the engine 9 resulting from the acceleration in rotational speed can be prevented.

FIG. 5 show time charts representing the swing deceleration regenerative control by the hydraulic drive system 105, wherein (a) shows the manipulated variable of the operating lever 56*d*, (b) shows the displacements of the double-tilting pumps/motors 14, 18, (c) shows the hydraulic fluid pressures in the flow paths 209, 210, (d) shows the rotational speed of the swing hydraulic motor 7, and (e) shows the flow rates of the hydraulic fluids that pass through the relief valves 51*a*, 51*b*.

Where a swing deceleration is instructed by operating the operating lever 56*d* from the maximum manipulated variable to the out-of-operation as shown in FIG. 5(*a*) with the operating lever 56*a* being operated and where the regeneration-possible amount E is larger than the swing deceleration regenerative torque Es, the load acting on the engine 9 is larger than the swing deceleration regenerative energy regenerated by the double-tilting pumps/motors 14, 18, and thus, all of the swing deceleration regenerative energy can be regenerated by the double-tilting pumps/motors 14, 18.

Therefore, the pump valve control section 57*d* sets a displacement return speed dDe by the use of Expression (5). Then, the displacement command value D3 for the double-tilting pumps/motors 14, 18 is again set based on the set displacement return speed dDe. At this time, it is determined in dependence on the set value of the inertia moment J in Expression (5) whether the hydraulic fluid pressure in the flow path 218 or the flow path 219 during the deceleration of the swing hydraulic motor 7 rises up to the set relief pressure of the relief valve 51*a* or the relief valve 51*b* or goes down lower than the set relief pressure of the relief valve 51*a* or the relief valve 51*b*.

Where the value equal to the inertia moment that is determined in dependence on the revolving upperstructure 102 of the actual hydraulic excavator 100 as well as on the posture during the swing operation of the front working assembly 104 is set as the inertia moment J in the pump valve control section 57*d*, the pressure of the hydraulic fluid discharged from the swing hydraulic motor 7 with the revolving upperstructure 102 being decelerated rises up to the set relief pressure as shown in FIG. 5(*c*), so that a deceleration torque is generated in the swing hydraulic motor 7. Consequently, the rotational speed of the swing hydraulic motor 7 goes to be decelerated, as shown in FIG. 5(*d*). At this time, almost all of the hydraulic fluid discharged from the swing hydraulic motor 7 is supplied to the double-tilting pumps/motors 14, 18, whereby as shown in FIG. 5(*e*), the flow rate of the hydraulic fluid that passes through the relief valve 51*b* is decreased in comparison with the flow rate of the hydraulic fluid shown in FIG. 4(*e*).

On the other hand, where the inertia moment J in the pump valve control section 57*d* is set to be larger than the inertia moment during the swing operation, the flow rates of the hydraulic fluids that the double-tilting pumps/motors 14, 18 are able to draw become more than the flow rate of the hydraulic fluid that is discharged from the swing hydraulic motor 7 with the revolving upperstructure 102 being decelerated. Thus, it is possible to regenerate all of the swing deceleration regenerative energy owned by the hydraulic fluid that is discharged from the swing hydraulic motor 7 with the revolving upperstructure 102 being decelerated. However, since the pressure of the hydraulic fluid in the flow path 218 or the flow path 219 becomes the set relief pressure or lower, the deceleration torque acting on the swing hydraulic motor 7 is lowered. Accordingly, it results that the time taken to effect the swing stop is elongated.

Further, where the inertia moment J in the pump valve control section 57*d* is set to be smaller than the inertial moment during the swing operation, the flow rates of the hydraulic fluids drawn by the double-tilting pumps/motors 14, 18 become less than the flow rate of the hydraulic fluid that is discharged from the swing hydraulic motor 7 with the revolving upperstructure 102 being decelerated. In this case, although it is possible to regenerate the swing deceleration regenerative energy owned by the hydraulic fluid that is discharged from the swing hydraulic motor 7 with the revolving upperstructure 102 being decelerated, the pressure in the flow path 218 or the flow path 219 goes down to the relief pressure, and much of the hydraulic fluid discharged from the swing hydraulic motor 7 passes through the relief valve 51*a* or the relief valve 51*b*. As a consequence, the regeneration amount of the swing deceleration regenerative energy is little, and much of the swing deceleration regenerative energy is discarded from the relief valve 51*a* or the relief valve 51*b*.

Further, the double-tilting pumps/motors 14, 18 regenerate the swing deceleration regenerative energy and hence, operate as hydraulic motors to generate torques. These torques act on the engine 9 through the power transmission device 10. Then, the torques generated in the double-tilting pumps/motors 14, 18 are made to act in a direction to drivingly rotate the engine 9, whereby the load torque against the engine 9 can be reduced. Accordingly, it is possible to the decrease the fuel injection quantity that is required to keep the rotational speed of the engine 9 in the state that the revolving upperstructure 102 is being decelerated, and hence, to reduce the quantity of fuel consumption.

Further, of the swing deceleration regenerative energy owned by the hydraulic fluid that is discharged from the swing hydraulic motor 7 with the revolving upperstructure 102 being decelerated, the energy left without being regenerated by the double-tilting pump/motor 18 is regenerated by another double-tilting pump/motor 14 that is not being used in driving any other hydraulic actuator than the swing hydraulic motor 7. Therefore, the swing deceleration regenerative energy can be regenerated efficiently and properly in comparison with the case that only one unit of the double-tilting pump/motor 18 regenerates the swing deceleration regenerative energy owned by the hydraulic fluid that is discharged from the swing hydraulic motor 7 with the revolving upperstructure 102 being decelerated. That is, by effectively utilizing the double-tilting pump/motor 14 which is not being used in driving any of the boom cylinder 1 and the arm cylinder 3, it becomes possible to heighten the regenerative ratio of the swing deceleration regenerative energy.

Second Embodiment

In the present second embodiment, the pump valve control section 57*d* is given the function that determines the displacement command values D2, D3 for the double-tilting pumps/motors 14, 18 during the swing deceleration regeneration by the use of pressure information in the flow paths 209, 210. That is, the difference of the present second embodiment from the foregoing first embodiment resides in that when the swing deceleration detection section 57*a* detects the state of the revolving upperstructure 102 being decelerated and when the regeneration-possible amount calculation section 57*b* sets the regeneration-possible amount E, the pump valve control section 57*d* determines the displacement command values D2, D3 for the double-tilting pumps/motors 14, 18 by the use of pressure information in the flow paths 209, 210. Incidentally, in the present second embodiment, parts identical or corresponding to those in the first embodiment will be given the same reference numerals.

<Configuration>

In the present second embodiment, when the regeneration-possible amount calculation section 57*b* sets the regeneration-possible amount E, the pump valve control section 57*d* uses the following Expression (8) instead of Expression (5) in the foregoing first embodiment and again sets the displacement command values D2, D3 for the double-tilting pumps/motors 14, 18.

$$D2=Kp(Pe-Pf)+D2,\ D3=Kp(Pe-Pf)+D3 \qquad \text{Expression (8)}$$

Here, symbol Kp is a positive constant and is a proportional gain applied to the pressure difference (Pe−Pf) that acts on the double-tilting pumps/motors 14, 18. As this Kp, a value is set which is searched through experiments, for example and which is able to decrease the flow rate of hydraulic fluid that passes through the relief valve 51*a* or the relief valve 51*b* with the revolving upperstructure 102 being decelerated. Further, where the D2 and D3 are set as positive values, the pressure in the flow path in the direction in which the double-tilting pumps/motors 14, 18 discharge the hydraulic fluids is taken as Pf, while the pressure in the flow path in the direction in which the double-tilting pumps/motors 14, 18 draw the hydraulic fluids is taken as Pe. The control of the changeover valves 43*a*, 45*b*, 45*d*, 49*d* by the pump valve control section 57*d* is the same as the operation of the pump valve control section 57*d* in the foregoing first embodiment.

<Operation and Effects>

In the foregoing first embodiment, the set value of the inertia moment J for the revolving upperstructure 102 and the front working assembly 104 in Expression (5) determines whether in the state that the revolving upperstructure 102 on the swing hydraulic motor 7 is being decelerated, the pressure of the hydraulic fluid in the flow path 218, 219 rises up to the set relief pressure or remains less than the set relief pressure. This results in discarding much of the swing deceleration regenerative energy through the relief valve 51*a*, 51*b* or causing the pressure of the hydraulic fluid in the flow path 218 or the flow path 219 to remain less than the set relief pressure and thus causing the deceleration torque acting on the swing hydraulic motor 7 to go down, whereby the time take to stop the swinging is elongated. However, it is not easy to calculate the inertia moment J each time the hydraulic excavator 100 performs a swing operation.

In the present second embodiment, the swing deceleration detection section 57*a* detects whether the revolving upperstructure 102 is being decelerated or not and, when the regeneration-possible amount calculation section 57*b* sets the regeneration-possible amount E, calculates the pressure difference between the flow paths 209 and 210 and the discharge direction based on the hydraulic fluid pressure information in the flow paths 209, 210 detected by the pressure sensors 62*a*, 62*b*, and based on the calculated pressure difference and discharge direction, the pump valve control section 57*d* sets the displacement command values D2, D3 for the double-tilting pumps/motors 14, 18. That is, in the control device 57 according to the present second embodiment, when for example, the suction pressure Pe of the double-tilting pumps/motors 14, 18 goes up to the set relief pressure with the revolving upperstructure 102 being decelerated, the discharge pressure Pf is lower than the suction pressure Pe, and thus, the pump valve control section 57*d* increases by the use of Expression (8) the displacement command values D2, D3 in correspondence to the pressure difference between the discharge pressure Pf and the suction pressure Pe.

Therefore, since the displacement command values D2, D3 for the double-tilting pumps/motors 14, 18 are each increased thereby to increase the suction flow rate of the hydraulic fluids by these double-tilting pumps/motors 14, 18, it is possible to decrease the flow rate of the hydraulic fluid that passes through the relief valve 51*a*, 51*b* with the revolving upperstructure 102 being decelerated. As a result, it is possible to increase the regeneration amount of the swing deceleration regenerative energy owned by the hydraulic fluid that is discharged from the swing hydraulic motor 7 with the revolving upperstructure 102 being decelerated. Further, the displacement command values D2, D3 for the double-tilting pumps/motors 14, 18 are set based on the pressure information in the flow paths 209, 210 detected by the pressure sensors 62*a*, 62*b*, and thus, of the swing deceleration regenerative energy owned by the hydraulic fluid that is discharged from the swing hydraulic motor 7 with the revolving upperstructure 102 being decelerated, the energy that can be regenerated by the double-tilting pump/motor 18 becomes possible to be calculated, and the setting of the displacement command values D2, D3 being proper becomes possible each time the hydraulic excavator 100 performs a swing operation. Further, because the swing deceleration regenerative energy left without being regenerated by the double-tilting pump/motor 18 can be efficiently regenerated by the double-tilting pump/motor 14 of a minimum required number being at least one, it becomes possible to reduce the mechanical loss (pipe resistance, pressure loss in pump driving, and the like) in the energy owned by the hydraulic fluid which loss is caused in supplying the hydraulic fluid that is discharged from the swing hydraulic motor 7 during the swing deceleration, to another double-tilting pump/motor 12 or the like by way of the another combining flow path (not shown), and therefore, it becomes possible to regenerate the swing deceleration regenerative energy efficiently and properly.

Third Embodiment

Figure 6:
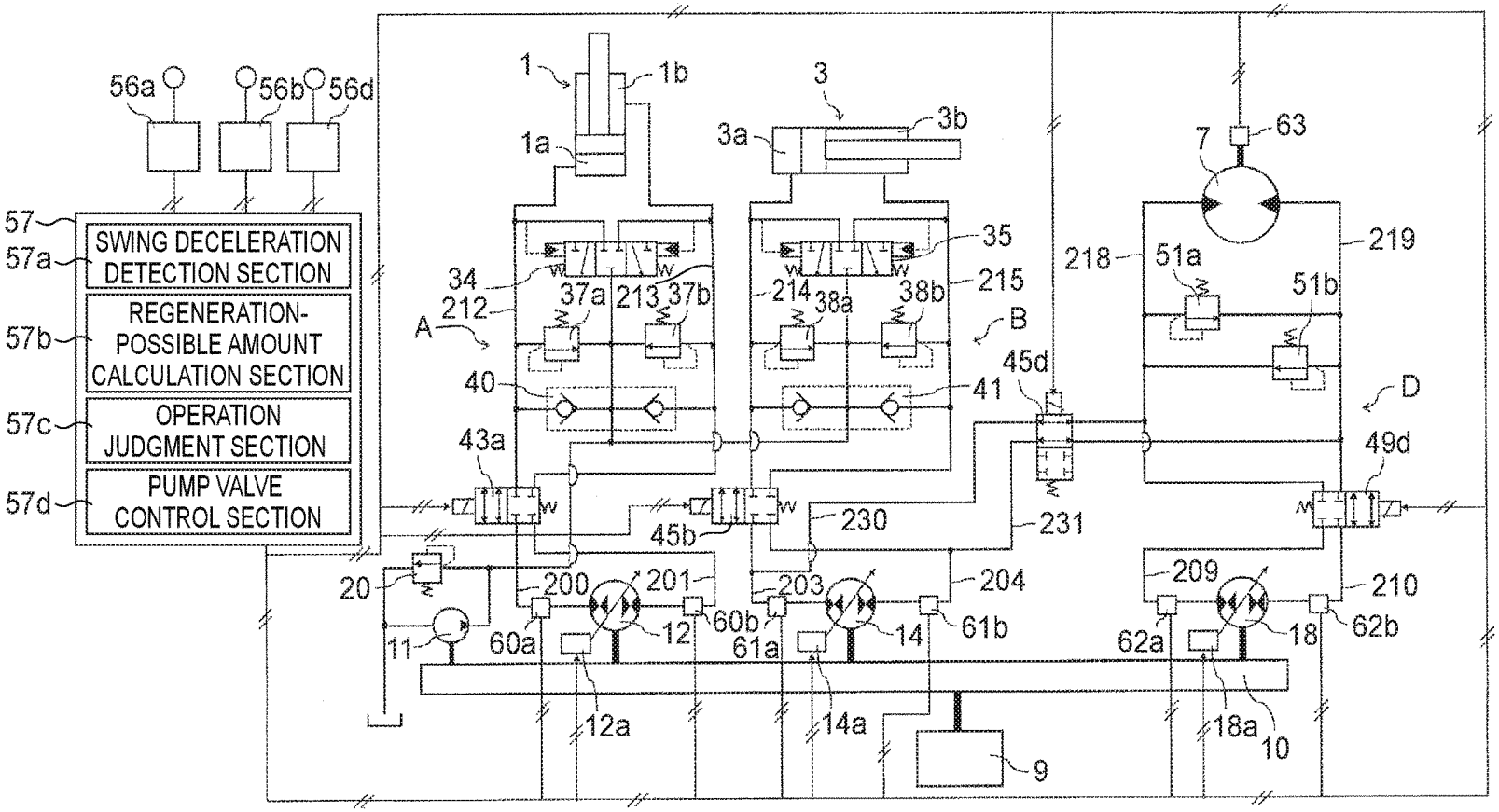
FIG. 6 is a schematic diagram showing a major configuration of a hydraulic drive system mounted on a work machine according to a third embodiment of the present invention.

FIG. 6 is a schematic diagram showing a major configuration of a hydraulic drive system 105A mounted on the hydraulic excavator 100 according to a third embodiment of the present invention. In the present third embodiment, the pump valve control section 57*d* is given the function that determines the displacement command values D2, D3 for the double-tilting pumps/motors 14, 18 during the swing deceleration regeneration by the use of the rotational speed information of the swing hydraulic motor 7. That is, the difference of the present third embodiment from the foregoing first embodiment resides in that a rotational speed sensor 63 is attached to the swing hydraulic motor 7 so that the pump valve control section 57*d* detects the rotational speed of the hydraulic motor 7 by the rotational speed sensor 63 through a control signal line and also in that the displacement command values D2, D3 for the double-tilting pumps/motors 14, 18 during the swing deceleration regeneration are determined by the use of the rotational speed information detected by the pump valve control section 57*d*. Incidentally, in the present third embodiment, parts identical or corresponding to those in the first embodiment will be given the same reference numerals.

<Configuration>

In the present third embodiment, when the regeneration-possible amount calculation section 57*b* sets the regeneration-possible amount E, the pump valve control section 57*d* detects a rotational speed Rm of the swing hydraulic motor 7 by the rotational speed sensor 63 as a rotational speed detection section. The pump valve control section 57*d* uses the following Expression (9) in place of Expression (5) according to the foregoing first embodiment and again sets the displacement command values D2, D3 for the double-tilting pumps/motors 14, 18.

$$D2=Dm\times Rm/\mathrm{Re}/2,\ D3=Dm\times Rm/\mathrm{Re}/2 \qquad \text{Expression (9)}$$

Here, symbol Re denotes the rotational speeds of the double-tilting pumps/motors 14, 18. This Re may take, for example, a predetermined constant that is set in advance based on a command rotational speed of the engine 9 and the gear ratio of the power transmission device 10. The control of the changeover valves 43*a*, 45*b*, 45*d*, 49*d* by the pump valve control section 57*d* is the same as the operation of the pump valve control section 57*d* in the foregoing first embodiment.

Further, the regeneration-possible amount calculation section 57*b* calculates the discharge flow rate of the swing hydraulic motor 7 that is calculated from the rotational speed Rm of the swing hydraulic motor 7 detected by the rotational speed sensor 63, and based on the calculated discharge flow rate of the swing hydraulic motor 7, calculates the number of the double-tilting pumps/motors 12, 14, 18 for use in regenerating the swing deceleration regenerative energy. Specifically, the regeneration-possible amount calculation section 57*b* calculates a minimum pump number that satisfies the relation of (discharge flow rate of double-tilting pump/motor 18)×(number of pumps)>(discharge flow rate of swing hydraulic motor 7) and calculates this number of the pumps as the number of double-tilting pumps/motors 12, 14, 18 used in regenerating the swing deceleration regenerative energy.

<Operation and Effects>

The present third embodiment takes the configuration that when the swing deceleration detection section 57*a* detects whether the revolving upperstructure 102 is being decelerated or not and when the regeneration-possible amount calculation section 57*b* sets the regeneration-possible amount E, the pump valve control section 57*d* detects the rotational speed Rm of the swing hydraulic motor 7 by the rotational speed sensor 63 and sets the displacement command values D2, D3 for the double-tilting pumps/motors 14, 18 based on the detected rotational speed Rm by the use of Expression (9).

As a consequence, based on the rotational speed Rm of the swing hydraulic motor 7, the displacement command values D2, D3 for the double-tilting pumps/motors 14, 18 are set so as to make it possible to draw all of the hydraulic fluid that is discharged from the swing hydraulic motor 7 with the revolving upperstructure 102 being decelerated, and thus, it becomes possible to make the double-tilting pumps/motors 14, 18 draw the hydraulic fluid of the flow rate equal to the flow rate of the hydraulic fluid that is discharged from the swing hydraulic motor 7 with the revolving upperstructure 102 being decelerated. Further, because the displacement command values D2, D3 are set based on the rotational speed Rm of the swing hydraulic motor 7 detected by the rotational speed sensor 63, the swing deceleration regenerative energy owned by the hydraulic fluid that is discharged from the swing hydraulic motor 7 with the revolving upperstructure 102 being decelerated can be grasped accurately, and hence, it becomes possible to set the displacement command values D2, D3 being proper each time the hydraulic excavator 100 carries out a swing operation.

Therefore, it is possible to decrease the flow rate of the hydraulic fluid that passes through the relief valve 51*a*, 51*b* with the revolving upperstructure 102 being decelerated, and hence, it is possible to increase the regeneration amount of the swing deceleration regenerative energy owned by the hydraulic fluid that is discharged from the swing hydraulic motor 7 with the revolving upperstructure 102 being decelerated. At the same time, it becomes possible to reduce the pressure loss in the hydraulic fluid which loss is caused in supplying the hydraulic fluid in the closed circuit D to the closed circuit B by way of the combining flow path 230, 231, and therefore, it becomes possible to regenerate the swing deceleration regenerative energy more efficiently and properly.

Fourth Embodiment

Figure 7:
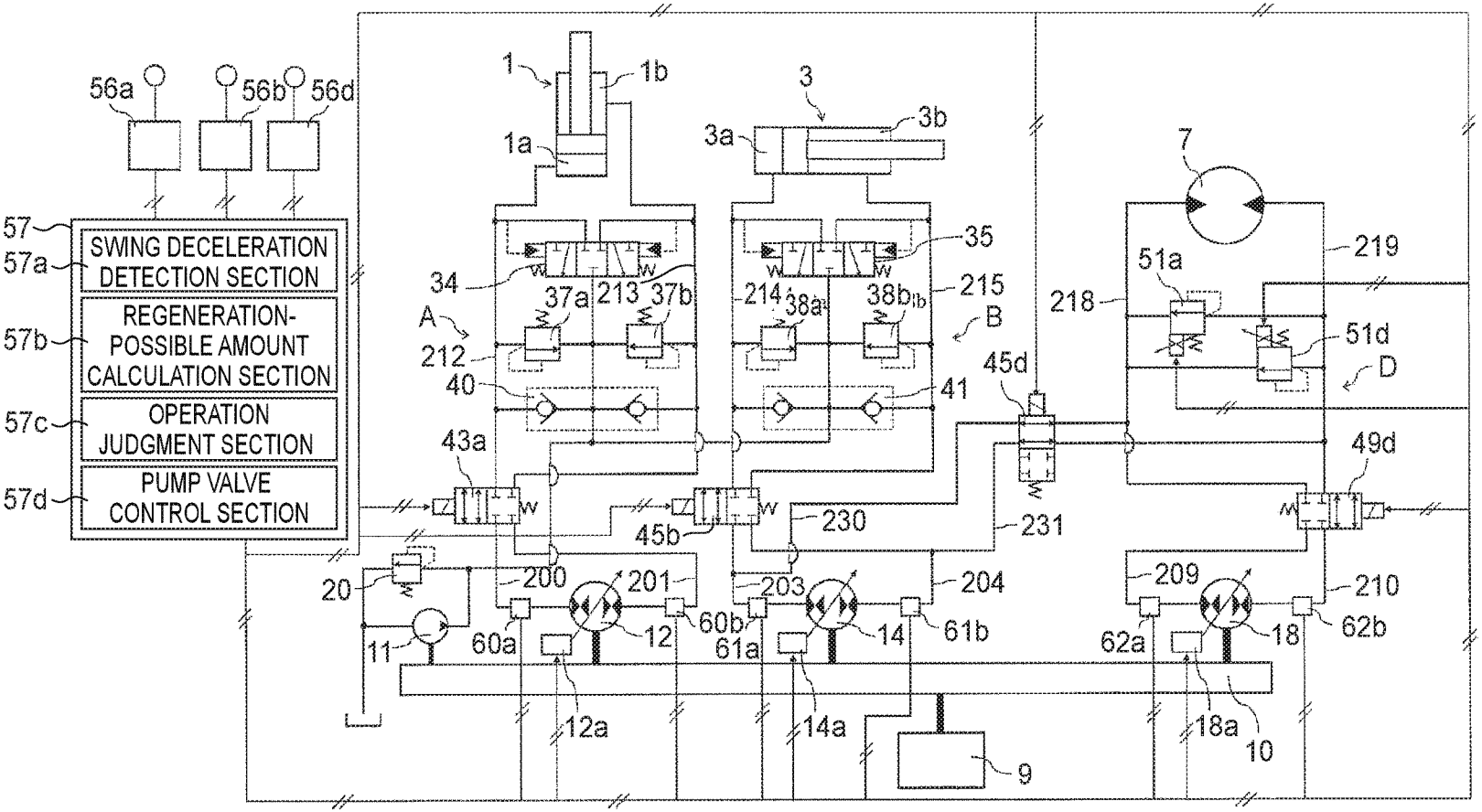
FIG. 7 is a schematic diagram showing a major configuration of a hydraulic drive system mounted on a work machine according to a fourth embodiment of the present invention.

FIG. 7 is a schematic diagram showing a major configuration of a hydraulic drive system 105B mounted on the hydraulic excavator 100 according to a fourth embodiment of the present invention. In the present fourth embodiment, the relief valves 51*a*, 51*b* in the hydraulic drive system 105 according to the foregoing first embodiment are configured as variable relief valves 51*c*, 51*d* whose set relief pressure are variable, and the pump valve control section 57*d* is given the function that is able to vary the set relief pressures of the variable relief valves 51*c*, 51*d* through control signal lines. That is, the difference of the present forth embodiment from the foregoing first embodiment resides in that the swing deceleration detection section 57*a* detects whether the revolving upperstructure 102 is being decelerated or not and that when the regeneration-possible amount calculation section 57*b* sets the regeneration-possible amount E, the pump valve control section 57*d* outputs control signals to raise the set relief pressures of the variable relief valves 51*c*, 51*d*. Incidentally, in the present fourth embodiment, parts identical or corresponding to those in the second embodiment will be given the same reference numerals.

<Configuration>

In the present fourth embodiment, when the regeneration-possible amount calculation section 57*b* sets the regeneration-possible amount E, the pump valve control section 57*d* sets the displacement command values D2, D3 for the double-tilting pumps/motors 14, 18 by the use of Expression (8). At the same time, the pump valve control section 57*d* outputs to the variable relief valves 51*c*, 51*d* control signals to raise the set relief pressures of these variable relief 51*c*, 51*d*, whereby these variable relief valves 51*c*, 51*d* are caused to heighten the set relief pressures. Incidentally, the control by the pump valve control section 57*d* of the changeover valves 43*a*, 45*b*, 45*d*, 49*d* is the same as the operation of the pump valve control section 57*d* in the foregoing first embodiment.

<Operation and Effects>

In the foregoing second embodiment, in the state that the revolving upperstructure 102 is being decelerated, the pump valve control section 57*d* increases the displacement command values D2, D3 by the use of Expression (8), whereby the suction flow rates of the double-tilting pumps/motors 14, 18 are increased to decrease the flow rates of the hydraulic fluids that pass through the relief valves 51*a*, 51*b* with the revolving upperstructure 102 being decelerated. As a consequence, it becomes possible to increase the regeneration amount of the swing deceleration regenerative energy owned by the hydraulic fluid that is discharged from the swing hydraulic motor 7 with the revolving upperstructure 102 being decelerated. However, when the hydraulic fluid pressure in the flow path 218, 219 rises to the set relief pressure of the relief valve 51*a*, 51*b*, the discharge pressure Pf and the suction pressure Pe in Expression (8) each become not to vary, and thus, when the hydraulic fluid pressure rises to the set relief pressure, a hunting is liable to be induced ahead and behind the set relief pressure together with the open and closing operation of the relief valve 51*a*, 51*b*.

Accordingly, although it is desirable to set the displacement command values D2, D3 by the use of Expression (8) at a stage that the hydraulic fluid pressures in the flow paths 218, 219, that is, the discharge pressure Pf and the suction pressure Pe are varying, it is necessary to control the displacement command values D2, D3 so that these discharge pressure Pf and suction pressure Pe become pressures that are lower than the set relief pressure. Further, because the deceleration torque of the swing hydraulic motor 7 that is determined by the difference in pressure (difference pressure) between the discharge pressure Pf and the suction pressure Pe becomes lower than that in the case where the deceleration is performed by the set relief pressure, there is an anxiety that a satisfactory swing stop performance cannot be obtained because of the extension of the time taken to effect the swing stop.

On the other hand, in the present fourth embodiment, the configuration is taken that the swing deceleration detection section 57*a* detects whether the revolving upperstructure 102 is in the state of being decelerated or not and that, when the regeneration-possible amount calculation section 57*b* sets the regeneration-possible amount E, the pump valve control section 57*d* outputs control signals to raise the set relief pressures of the variable relief valves 51*c*, 51*d* so that the set relief pressures of the variable relief valves 51*c*, 51*d* are raised. Further, by the use of Expression (8), the displacement command values D2, D3 are set so that the discharge pressure Pf or the suction pressure Pe in the flow path 218, 219 becomes a pressure equal to the set relief pressure of the relief valve 51*a*, 51*b* in the foregoing first embodiment.

As a consequence, because the deceleration torque of the swing hydraulic motor 7 that depends on the pressure difference between the discharge pressure Pf and the suction pressure Pe becomes equal to that in the case where the deceleration is effected by the set relief pressure in the relief valve 51*a*, 51*b* in the foregoing first embodiment, it is possible to shorten the time that the revolving upperstructure 102 in the state of being decelerated takes to reach the swing stop, and hence, it is possible to acquire a satisfactory swing stop performance. At the same time, it is possible to reduce the flow rate of the hydraulic fluid that is discharged from the variable relief valve 51*c*, 51*d* in the state of the revolving upperstructure 102 being decelerated, and hence, it is possible to increase the regeneration amount of the swing deceleration regenerative energy owned by the hydraulic fluid that is discharged from the swing hydraulic motor 7 with the revolving upperstructure 102 being decelerated.

[Others]

Incidentally, the present invention is not limited to the foregoing embodiments and may encompass various modified forms. For example, the foregoing embodiments have been described for the purpose of describing the present invention to be easily understood, and the present invention is not necessarily limited to those provided with all of the described configurations.

Further, although in each of the foregoing embodiments, description has been made regarding the swing regeneration control in the case where the boom cylinder 1 is driven to extend and contract simultaneously with the swing driving of the revolving upperstructure 102, the present invention is also applicable to the case that at the same time as the swing driving of the revolving upperstructure 102, the arm cylinder 3 and the bucket cylinder 5 are driven to extend and contract or the traveling hydraulic motors 8*a*, 8*b* are driven. For example, also in the extension/contraction driving of the bucket cylinder 5, it is possible to regenerate, by the double-tilting pumps/motors 14, 18, the swing deceleration regenerative energy owned by the hydraulic fluid discharged from the swing hydraulic motor 7 when the regeneration-possible amount E is larger than the swing deceleration regenerative torque Es. Therefore, the present invention is also applicable to the case where the bucket cylinder 5 is driven to extend and contract at the same time of the swing driving of the revolving upperstructure 102.

Furthermore, the state that the rotational speed of the swing hydraulic motor 7 is being decelerated in response to a drive command outputted in dependence on the manipulated variable of the operating lever 56*d*, that is, the state that the revolving upperstructure 102 is being decelerated is detected by the swing deceleration detection section 57*a*. Instead, the state that the revolving upperstructure 102 is being decelerated may be detected from, for example, the variation amount or the like of the rotational speed of the swing hydraulic motor 7. Alternatively, the state that the revolving upperstructure 102 is being decelerated may be detected from the pressure change or the like in the hydraulic fluids in the flow path 218, 219 or the flow path 209, 210.

Further, the decrease amounts of the displacement command values D2, D3 for the double-tilting pumps/motors 14, 18 are controlled by the pump valve control section 57*d*, wherein these displacement command values D2, D3 are decreased to become "O" gradually in correspondence to the displacement return speed dDe. Instead, there may be taken a configuration that the pump valve control section 57*d* sets the displacement command values D2, D3 to "0" when a predetermined fixed period of time lapses after the swing deceleration detection section 57*a* detects the state that the revolving upperstructure 102 is being decelerated.

Further, although description has been made taking as an example the case wherein the present invention is applied to the hydraulic excavator 100, the present invention is also applicable to other work machines than the hydraulic excavator 100. For example, the present invention is applicable if the work machine is a work apparatus such as a hydraulic crane or the like and is provided with a hydraulic motor capable of performing a swing driving.

Further, although hydraulic pumps with single-tilting swash plate mechanisms capable of controlling the flow rate only are taken as the single-tilting pumps 13, 15, 17, 19, there may be used hydraulic pumps with tilting swash plate mechanisms capable of controlling the discharge direction and the flow rate.

Furthermore, the changeover valves 44*a*-44*d*, 46*a*-46*d*, 48*a*-48*d*, 50*a*-50*d*, the proportional changeover valves 54, 55 and the bleed-off valves 64-67 are not only directly controlled by the control signals outputted from the control device 57 but may also be controlled by hydraulic signals into which the control signals outputted by the control device 57 are converted by the use of electromagnetic reducing valves and the like.

Moreover, the hydraulic actuators driven by the double-tilting pumps/motors 12, 14, 16 which regenerate the swing deceleration regenerative energy owned by the hydraulic fluid that is discharged from the oil swing hydraulic motor 7 with the revolving upperstructure 102 being swung may be hydraulic motors without being limited to the hydraulic cylinders such as the boom cylinder 1, the arm cylinder 3, the bucket cylinder 5 and the like.

REFERENCE SIGNS LIST

1 . . . boom cylinder (third hydraulic actuator)
3 . . . arm cylinder (second hydraulic actuator)
5 . . . bucket cylinder (hydraulic actuator)
7 . . . swing hydraulic motor (first hydraulic motor)
9 . . . engine
12 . . . third pump/motor
14 . . . second pump/motor
16 . . . double-tilting pump/motor
18 . . . double-tilting pump/motor (first pump/motor)
43*a* . . . changeover valve (third switching device)
45*b* . . . changeover valve (second switching device)
47*c* . . . changeover valve
45*d* . . . changeover valve (first combining flow path switching device)
49*d* . . . changeover valve (first switching device)
51*c*, 51*fd* . . . variable relief valve
56*d* . . . operating lever (operating device)
57 . . . control device
57*a* . . . swing deceleration detection section
57*b* . . . regeneration-possible amount calculation section (regeneration-use pump number calculation section)
57*c* . . . operation judgment section (pump operation judgment section)
57*d* . . . pump valve control section (control section)
60*a*, 60*b* . . . pressure sensor (pressure detection section)
63 . . . rotational speed sensor (rotational speed detection section)
100 . . . hydraulic excavator (work machine)
102 . . . revolving upperstructure
104 . . . front working assembly
105, 105A, 105B . . . hydraulic drive system
230 . . . combining flow path (first combining flow path switching device)
231 . . . combining flow path (first combining flow path switching device)
A . . . closed circuit (third hydraulic closed circuit)
B . . . closed circuit (second hydraulic closed circuit)
C . . . closed circuit
D . . . closed circuit (first hydraulic closed circuit)

The invention claimed is:

1. A work machine comprising:

a first hydraulic circuit in which a hydraulic motor as a first actuator for drivingly swinging a revolving upperstructure and a first pump/motor enabling the outflow/inflow of hydraulic fluid in both directions and being controllable in displacement are connected in a closed circuit style by a flow path enabling hydraulic fluid to flow and in which a first switching device is provided for selectively opening the flow path between the hydraulic motor and the first pump/motor;

a second hydraulic circuit in which a second hydraulic actuator differing from the hydraulic motor and a second pump/motor enabling the outflow/inflow of hydraulic fluid in both directions and being controllable in displacement are connected in a closed circuit style by a flow path enabling hydraulic fluid to flow and in which a second switching device is provided for selectively opening the flow path between the second hydraulic actuator and the second pump/motor;

a combining flow path connected between the first hydraulic circuit and the second hydraulic circuit;

a first combining flow path switching device that selectively opens the first combining flow path; and a control device that controls the first and second pumps/motors, the first and second switching devices and the first combining flow path switching device, wherein:

the control device includes a swing deceleration detection section that detects the state of the revolving upperstructure being decelerated, a pump operation judgment section that judges the operation state of the second pump/motor, and a control section that controls the displacements of the first and second pumps/motors and the selective openings of the first and second switching devices and the first combining flow path switching device; and when the swing deceleration detection section detects the state of the revolving upperstructure being decelerated, when the pump operation judgment section judges the state that the second pump/motor is in the state of not supplying hydraulic fluid to the second hydraulic actuator, and when inertia energy attendant on the swing operation is unable to be regenerated by the first pump/motor only, the control section outputs an open signal to the first switching device, outputs a closing signal to the second switching device, outputs an open signal to the first combining flow path switching device that merges the second hydraulic closed circuit and the first hydraulic closed circuit, and further controls the displacement of the first pump/motor and the displacement of the second pump/motor to make respective suction pressures higher than respective discharge pressures so that the first pump/motor and the second pump/motor operate as motors, a third hydraulic circuit in which a third hydraulic actuator differing from the first hydraulic actuator and the second hydraulic actuator and a third pump/motor enabling the outflow/inflow of hydraulic fluid in both directions and being controllable in displacement are connected in a closed circuit style by a flow path enabling hydraulic fluid to flow and in which the third switching device is provided for selectively opening the flow path between the third hydraulic actuator and the third pump/motor;

a second combining flow path connected between the first hydraulic closed circuit and the third hydraulic closed circuit; and a second combining flow path switching device that selectively opens the second combining flow path, wherein:

when the swing deceleration detection section detects the state of the revolving upperstructure being decelerated, when the pump operation judgment section judges that the third pump/motor is in the state of not supplying hydraulic fluid to the third hydraulic actuator and when inertia energy attendant on the swine operation is unable to be regenerated by the first and the second pumps/motors only, the control section further outputs a closing signal to the third switching device, outputs an oven signal to the second combining flow path switching device that merges the third hydraulic closed circuit and the first hydraulic closed circuit, and controls the displacement of the third pump/motor to make the suction pressure become higher than the discharge pressure so that the third pump/motor operates as a motor;

the first hydraulic closed circuit is further provided with a variable relief valve capable of controlling a relief pressure for the hydraulic fluid in the first hydraulic closed circuit;

when the swing deceleration detection section detects the state of the revolving upperstructure being decelerated, the control section raises the relief pressure for the variable relief valve and then controls respective displacements of a pump/motor of the second and third pumps/motors which is not supplying hydraulic fluid to the second or third hydraulic actuator, and the first pump/motor based on the pressure difference detected by the pressure detection section so that in the first and second pumps/motors, a suction pressure becomes higher than a discharge pressure.

2. The work machine according to claim 1, further comprising an operating device for operating the swing drive of the revolving upperstructure;

wherein when the operating device is operated to decelerate or stop the revolving upperstructure, the swing deceleration detection section detects the state of the revolving upperstructure being decelerated.

* * * * *